US008844581B2

(12) United States Patent
Higai et al.

(10) Patent No.: US 8,844,581 B2
(45) Date of Patent: Sep. 30, 2014

(54) CLOSED STRUCTURE PARTS, METHOD AND PRESS FORMING APPARATUS FOR MANUFACTURING THE SAME

(75) Inventors: Kazuhiko Higai, Hiroshima (JP); Yuji Yamasaki, Hiroshima (JP); Takaaki Hira, Chiba (JP); Katsuhiro Ochi, Hiroshima (JP)

(73) Assignee: JFE Steel Corporation (JP)

( * ) Notice: Subject to any disclaimer, the term of this patent is extended or adjusted under 35 U.S.C. 154(b) by 616 days.

(21) Appl. No.: 13/120,589

(22) PCT Filed: Sep. 24, 2009

(86) PCT No.: PCT/JP2009/067129
§ 371 (c)(1),
(2), (4) Date: Mar. 23, 2011

(87) PCT Pub. No.: WO2010/035887
PCT Pub. Date: Apr. 1, 2010

(65) Prior Publication Data

US 2011/0174409 A1 Jul. 21, 2011

(30) Foreign Application Priority Data

Sep. 25, 2008 (JP) ..... 2008-245464

(51) Int. Cl.

| | |
|---|---|
| ***B21D 22/00*** | (2006.01) |
| ***B21D 51/10*** | (2006.01) |
| ***B21D 39/02*** | (2006.01) |
| ***B21D 51/06*** | (2006.01) |
| ***B21D 47/01*** | (2006.01) |
| ***B21D 5/10*** | (2006.01) |

(52) U.S. Cl.
CPC *B21D 5/10* (2013.01); *B21D 51/10* (2013.01); *B21D 39/02* (2013.01); *B21D 51/06* (2013.01); *B21D 47/01* (2013.01)
USPC ..... 138/170; 138/171; 72/51; 72/367.1; 72/368; 29/513

(58) Field of Classification Search
USPC ..... 138/109, 170, 171, 167, 168, 163; 29/897.2, 521, 513, 505; 72/51, 52, 72/367.1, 368, 369, 343; 228/141
See application file for complete search history.

(56) References Cited

U.S. PATENT DOCUMENTS 3,909,919 A * 10/1975 Miyabayashi et al. ..... 29/521
4,055,133 A * 10/1977 Wessely ..... 413/6

(Continued)

FOREIGN PATENT DOCUMENTS

JP 95554/1974 2/1976
JP 57-184520 A 11/1982

(Continued)

*Primary Examiner* — Kevin P Shaver
*Assistant Examiner* — Robert Nichols, II
(74) *Attorney, Agent, or Firm* — DLA Piper LLP (US)

(57) ABSTRACT

The number of sub-parts of a closed structure part and the number of steps for manufacturing the closed structure part can be reduced and, therefore, the closed structure part can be efficiently manufactured. In a hemming press step, a punch is further lowered, and a pair of flange portions is inserted into a slit clearance. Hemming prongs are bent and each of the hemming prongs sandwiches the flange portion. The flange portion, which is one of the two flange portions, is joined to the other flange portion. At the same time, a pair of press forming surfaces of the punch presses a metal plate and performs press-forming on a pair of shoulder portions of a blank into a predetermined shape. The flange portion can be fixed to the other flange portion using the hemming prongs. The pair of shoulder portions of the blank can be press-formed into the predetermined shape.

10 Claims, 16 Drawing Sheets

(56) References Cited

U.S. PATENT DOCUMENTS

| | | | | | |
|---|---|---|---|---|---|
| 4,238,550 | A | * | 12/1980 | Burgess et al. | 428/586 |
| 4,395,900 | A | * | 8/1983 | Saurenman | 72/368 |
| 4,441,241 | A | * | 4/1984 | Hoeffken | 29/890.03 |
| 4,466,267 | A | * | 8/1984 | Casler et al. | 72/368 |
| 4,734,971 | A | * | 4/1988 | Dupasquier | 29/417 |
| 8,365,411 | B2 | * | 2/2013 | Saito et al. | 29/897.2 |
| 2007/0131015 | A1 | * | 6/2007 | Matsumura et al. | 72/368 |
| 2007/0145767 | A1 | * | 6/2007 | Saitoh et al. | 296/146.5 |
| 2011/0174868 | A1 | * | 7/2011 | Higai et al. | 228/136 |

FOREIGN PATENT DOCUMENTS

| | | | |
|---|---|---|---|
| JP | 5-228557 | | 9/1993 |
| JP | 2000-515432 | | 11/2000 |
| JP | 2006-247748 | | 9/2006 |
| JP | 2007-7176361 | | 7/2007 |
| WO | 02/42019 | A2 | 5/2002 |

* cited by examiner

CLOSED STRUCTURE PARTS, METHOD AND PRESS FORMING APPARATUS FOR MANUFACTURING THE SAME

RELATED APPLICATIONS

This is a §371 of International Application No. PCT/JP2009/067129, with an international filing date of Sep. 24, 2009, which is based on Japanese Patent Application No. 2008-245464, filed Sep. 25, 2008, the subject matter of which is incorporated by reference.

TECHNICAL FIELD

This disclosure relates to a press forming method for manufacturing a closed structure part having a closed section by press-forming a metal plate using a press forming die and fixing flange portions formed at a pair of joint ends of the metal plate to each other by hemming, a press forming apparatus used for the press forming method, a closed structure part manufactured using the press forming method, and a closed structure part with welded flanges.

BACKGROUND

For example, to manufacture a structural part having a closed section (a closed structure part), such as a side member or a side door of a vehicle (e.g., a motor vehicle), a plurality of sub-parts of the closed structure part are formed from a metal plate (e.g., a steel plate) using press forming (i.e., press sub-parts). Thereafter, one of the press-formed sub-parts is attached to another press sub-part, and the two press sub-parts are fixedly joined to each other by, for example, hemming or welding. In this way, a closed structure part is manufactured from a plurality of press sub-parts.

An example of such a closed structure part is a door structure of a vehicle described in Japanese Unexamined Patent Application Publication No. 2007-176361. The door structure of a vehicle described in JP 2007-176361 includes an inner panel and an outer panel each having a concave shape. The inner panel has, in an edge portion thereof, a hemming flange bent towards the outer panel. The hemming flange is bent to sandwich the edge portion of the outer panel. In this way, the inner panel is hemming joined to the outer panel.

In addition, Japanese Unexamined Patent Application Publication No. 5-228557 describes a hemming machine for joining an outer panel to an inner panel by hemming (press hemming) (refer to Paragraphs [0002] and [0003] and FIGS. 5 through 10). To join an outer panel to an inner panel, the hemming machine places the inner panel and the outer panel so that the inner panel and the outer panel overlap each other, brings a pre-hemming steel into contact with the top end portion of the hemming flange of the outer panel, and urges the top end portion in the diagonally downward direction to bend the top portion. Thereafter, the hemming machine moves the pre-hemming steel downward to further bend the hemming flange. The edge portion of the inner panel is sandwiched by the hemming flange of the outer panel. In this way, the outer panel is joined to the inner panel by hemming (hemming joint).

In addition, to manufacture a front side member, which is a closed structure part used for absorbing a shock occurring when the vehicle collides with an object, the flange portions formed for a plurality of press parts are firmly joined with one another using welding, such as spot welding, laser welding, or arc welding.

When manufacturing the above-described closed structure part having a closed section, a plurality of press sub-parts of the closed structure part are formed from, for example, a steel plate by pressing. Thereafter, the press sub-parts are placed to overlap one another. The flange portions of the press sub-parts are joined by hemming or welding. Thus, a plurality of press sub-parts are assembled into the closed structure part.

However, in general, the weight of a closed structure part having a closed section increases as the number of press sub-parts of the closed structure part increases. That is, if the number of the press sub-parts increases, a connection flange portion is needed for each of the press sub-parts. In addition, such a flange portion needs to be formed on either end of the press sub-part with an inner space therebetween. Accordingly, as the number of the press sub-parts increases, the ratio of the weight of the flange portions to the entire weight of the closed structure part increases. As a result, the weight of the closed structure part is increased.

In addition, such a closed structure part is manufactured through at least a press step to form a plurality of press sub-parts of the closed structure part using dedicated press forming dies and a hemming step to join the press sub-parts to one another by hemming. In recent years, to reduce the manufacturing cost of closed structure parts, it has been required to manufacture closed structure parts more efficiently than ever.

Accordingly, it could be helpful to provide a method and an apparatus capable of reducing the number of sub-parts of a closed structure part and the number of steps for manufacturing the closed structure part and, therefore, efficiently manufacturing the closed structure part. It could also be helpful to provide a lightweight closed structure part by reducing the number of sub-parts.

SUMMARY

We thus provide a method for manufacturing a closed structure part having a closed section using a metal plate by press-processing the metal plate using a press forming die and fixing a pair of flange portions made into a pair of joint ends of the metal plate to each other is provided. The method is characterized by including a pre-hemming step of bending a hemming prong protruding from a top end of the flange portion towards the flange portion, a closing step of, after the pre-hemming step is completed, urging a pair of insert guide surfaces formed on the press forming die against the top of the flange portion having the hemming prong therein, moving the press forming die in a predetermined pressing direction so that the two flange portions are brought closer to each other due to a force component perpendicular to the pressing direction that is generated by each of the insert guide surfaces, and guiding the pair of the flange portions into a slit clearance formed between the pair of insert guide surfaces of the press forming die, and a hemming press step of, after the closing step is completed, further moving the press forming die in the pressing direction, inserting the pair of flange portions into the slit clearance, simultaneously bending the hemming prong using a pressing force transferred from an inner surface portion of the slit clearance to a top portion of the hemming prong so that the other flange portion is sandwiched by the hemming prong and the flange portion is fixed to the flange portion and, simultaneously, pressing the metal plate using a press forming surface formed outside of each of the insert guide surfaces of the press forming die and press-forming outer portions of the pair of the flange portions of the metal plate into predetermined shapes.

In the method for manufacturing a closed structure part according to [1], after the pre-hemming step is completed, the closing step is performed. In the closing step, the pair of insert guide surfaces formed on the press forming die are urged against the top of the flange portion having the hemming prong therein. Simultaneously, the press forming die is moved in a predetermined pressing direction so that the two flange portions are brought closer to each other due to a force component perpendicular to the pressing direction that is generated by each of the insert guide surfaces, and the pair of the flange portions are guided into a slit clearance formed between the pair of insert guide surfaces of the press forming die. Thus, the pair of flange portions can be brought closer to each other against the deformation resistance (springback) of the metal plate serving as the material used for the closed structure part, and the distance between the pair of the flange portions can be set to correspond to the opening width of the slit clearance. Accordingly, if the opening width of the slit clearance is appropriately determined in accordance with the allowable value for the distance between the pair of flange portions, the distance between the pair of flange portions can be sufficiently reduced and can be maintained in the slit clearance.

In addition, in the method for manufacturing a closed structure part according to [1], after the closing step is completed, the hemming press step is performed. In the hemming press step, the press forming die is further moved in the pressing direction, and the pair of flange portions is inserted into the slit clearance. Simultaneously, the hemming prong is bent so that the flange portion is sandwiched by the hemming prong and the flange portion is fixed to the other flange portion. At the same time, the metal plate is pressed using a press forming surface formed outside of each of the insert guide surfaces of the press forming die, and press-forming outer portions of the pair of the flange portions of the metal plate are press-formed into predetermined shapes. Accordingly, the distance between the pair of flange portions can be sufficiently decreased. Thereafter, one of the flange portions can be fixed to the other flange portion using the hemming prong (hemming joint). At the same time, the outer portions of the pair of flange portions can be press-formed into a predetermined shape.

Therefore, according to the method for manufacturing a closed structure part described in [1], a closed structure part having a closed section can be manufactured using a single metal plate. In addition, since an operation for hemming joint of the pair of flange portions of the closed structure part and an operation for press-forming the outer portions of the flange portions can be performed at the same time, the number of sub-parts of the closed structure part and the number of steps for manufacturing the closed structure part can be reduced and, therefore, the closed structure part can be efficiently manufactured.

Furthermore, according to [2], the method for manufacturing a closed structure part described in [1] is characterized by further including a welding step of, after the hemming press step is completed, fixing one of the flange portions to the other flange portion by welding.

According to [3], a press forming apparatus for use in the method for manufacturing a closed structure part described in [1] or [2] is provided. The apparatus is characterized by including the press forming die and driving means for moving the press forming die in the pressing direction when the closing step and the hemming press step are performed. The press forming die has a pair of press forming surfaces having a shape corresponding to the outer portion of the pair of flange portions of the closed structure part, a pair of insert guide surfaces disposed on the outer sides of the press forming surfaces in a direction perpendicular to the pressing direction and oblique to the pressing direction and the direction perpendicular to the pressing direction, and the slit clearance formed between the pair of insert guide surfaces in the direction perpendicular to the pressing direction.

In the press forming apparatus used for manufacturing a closed structure part according to [3], by mounting a single metal plate in the press forming die and moving the press forming die in a predetermined pressing direction using the driving means, the distance between the pair of flange portions can be sufficiently decreased. Thereafter, one of the flange portions can be fixed to the other flange portion using the hemming prong (hemming joint). At the same time, the outer portions of the pair of flange portions of the metal plate (the closed structure part) can be press-formed into a predetermined shape. Therefore, a closed structure part having a closed section can be manufactured from a single metal plate. In addition, since an operation for hemming joint of the pair of flange portions of the closed structure part and an operation for press-forming the outer portions of the flange portions can be performed at the same time, the number of sub-parts of the closed structure part and the number of steps for manufacturing the closed structure part can be reduced and, therefore, the closed structure part can be efficiently manufactured.

In addition, according to [4], the press forming apparatus used for manufacturing a closed structure part is characterized in that in the press forming apparatus used for manufacturing a closed structure part described in [3], the depth of the slit clearance with respect to the insert guide surfaces is greater than or equal to 3 mm and less than or equal to 50 mm, and an opening width of the slit clearance in the direction perpendicular to the pressing direction is greater than or equal to 2 times a thickness of the metal plate serving as the material used for the closed structure part and less than or equal to 10 times the thickness of the metal plate.

According to [5], a closed structure part manufactured using the method for manufacturing a closed structure part described [1] or [2] is provided. The closed structure part is characterized by including a body having a closed section, a flange portion formed in each of a pair of joint ends of the body, and a hemming prong protruding from a top end of one of the flange portions, where the hemming prong is processed by hemming so that the one of the flange portions is fixed to the other flange portion.

In the closed structure part according to [5], the body, the flange portion, and the hemming prong are formed from a single metal plate. In addition, a hemming prong protruding from one of a top end of the flange portions is processed by hemming so that the one of the flange portions is fixed to the other flange portion. Thus, one of the flange portions is fixed to the other flange portion (hemming joint). In this way, the body, the pair of flange portions, and the flange prong, which are main components of the closed structure part, are integrally formed from a single metal plate. In addition, by joining the joint ends of the body with each other using only the pair of flange portions, the body can have a closed section. Accordingly, the number of sub-parts of the closed structure part can be reduced, and the ratio of the weight of the flange portions to the entire weight of the closed structure part can be reduced, as compared with a closed structure part including two or more independent sub-parts. Thus, the weight of the closed structure part can be efficiently reduced.

In addition, according to [6], a closed structure part is characterized in that in the closed structure part described in [5], a plurality of the hemming prongs are provided in the one of the flange portions in a width direction of the flange portion with a predetermined separation distance PH therebetween, and a width of each of the hemming prongs is set to a value greater than or equal to 2 times a thickness of the metal plate and less than or equal to a product length of the closed structure part. A protruding length of the hemming prong from the top end of the flange portion is set to a value greater than or equal to 1 time the thickness of the metal plate serving as the material used for the closed structure part and less than or equal to 1.5 times a flange height, and the separation distance PH is set to a value greater than or equal to 5 mm and less than or equal to a value obtained by subtracting the widths of the hemming prongs from the product length.

As described above, a method for manufacturing a closed structure part and a press forming apparatus used for manufacturing a closed structure part can reduce the number of sub-parts of the closed structure part and the number of manufacturing steps. As a result, a closed structure part can be efficiently manufactured.

In addition, the number of sub-parts of the closed structure part can be reduced and, thus, the weight of the closed structure part can be reduced.

DETAILED DESCRIPTION

Figure 1:
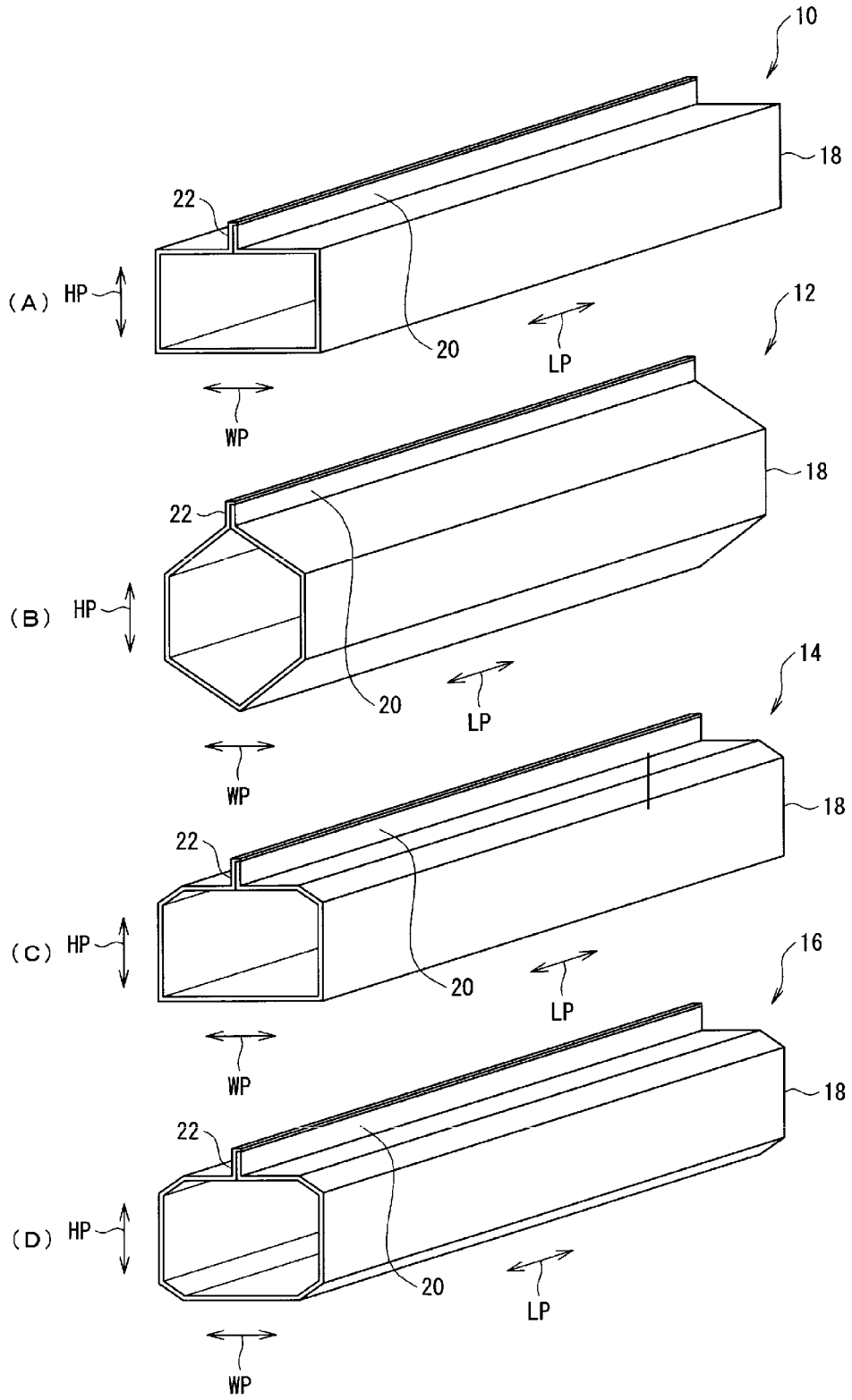
FIG. 1 is a perspective view of an example of a closed structure part manufactured using a method for manufacturing a closed structure part.

A method for manufacturing a closed structure part, a manufacturing apparatus used in the method, and the closed structure part manufactured using the method according to examples are described below with reference to the accompanying drawings.

(Structure of Closed Structure Part)

FIGS. 1(A) to 1(D) illustrate closed structure parts manufactured using methods for manufacturing a closed structure part. Each of closed structure parts 10 to 16 is used as part of a side member of the body of, for example, a motor vehicle. Each of the closed structure parts 10 to 16 is formed from a metal plate (a high-tensile steel plate in this example). As shown in FIGS. 1(A) to 1(D), each of the closed structure parts 10 to 16 is mounted in the vehicle so that the length direction thereof (a direction indicated by an arrow LP) is the front-rear direction of the vehicle. In addition, each of the closed structure parts 10 to 16 has an elongated tubular shape having an open end at either end.

Each of the closed structure parts 10 to 16 includes a main body 18 that has a closed section extending in a direction perpendicular to the length direction. Flange portions 20 and 22 are integrally formed as the pair of joint ends of the main body 18. The main body 18 and the pair of flange portions 20 and 22 are formed from a single high-tensile steel plate by press forming.

The main bodies 18 of the closed structure parts 10 to 16 have a variety of shapes in cross section in accordance with a required installation space and the required strength of the body of the vehicle. More specifically, for example, the main body 18 of the closed structure part 10 (refer to FIG. 1(A)) has a substantially rectangular shape in cross section. The length direction of the shape corresponds to the left-right direction of the vehicle. In addition, the main body 18 of the closed structure part 12 (refer to FIG. 1(B)) has a substantially regular hexagonal shape in cross section. Furthermore, the main body 18 of the closed structure part 14 (refer to FIG. 1(C)) has an irregular hexagonal shape in cross section, in which the corner portions on both sides of the upper end tapers downward. Still furthermore, the main body 18 of the closed structure part 16 (refer to FIG. 1(D)) has a substantially irregular octagonal shape in cross section, in which the corner portions on both sides of the upper end portion taper downward and the corner portions on both sides of the lower end portion taper upward.

Note that the cross-sectional shape of the main body 18 is not limited to the shapes shown in FIGS. 1(A) to 1(D). For example, the cross-sectional shape may be another polygonal shape. Alternatively, part or the entirety of the cross-sectional shape of the main body 18 can be a curved shape, such as an arc or an elliptic curve.

The pair of flange portions 20 and 22 are formed as the upper portions of each of the closed structure parts 10 to 16 in the vertical direction (a direction indicated by an arrow HP). The two flange portions 20 and 22 have symmetrical shapes in the width direction (a direction indicated by an arrow WP). The two flange portions 20 and 22 are formed by bending either of the end portions (a pair of joint ends) of the main body 18 in a direction perpendicular to the length direction upwards. In the states (finished states) indicated by FIGS. 1(A) to 1(D), the pair of flange portions 20 and 22 are joined together by using a variety of welding techniques, such as spot welding, laser welding, or arc welding.

To manufacture a side member using one of such closed structure parts 10 to 16, high stiffness cap members fixedly cap the ends of the closed structure parts 10 to 16 in the length direction of the closed structure parts 10 to 16 by insertion. Thereafter, a reinforcement member for reinforcing one of the closed structure parts 10 to 16 or a bracket, a bolt, or a nut for connecting the closed structure part to the vehicle is attached to the outer periphery or the inner periphery of the closed structure part as needed. In this way, a side member, which is a component of the body of the vehicle, is manufactured.

(Apparatuses for Manufacturing Closed Structure Part)

Figure 2:
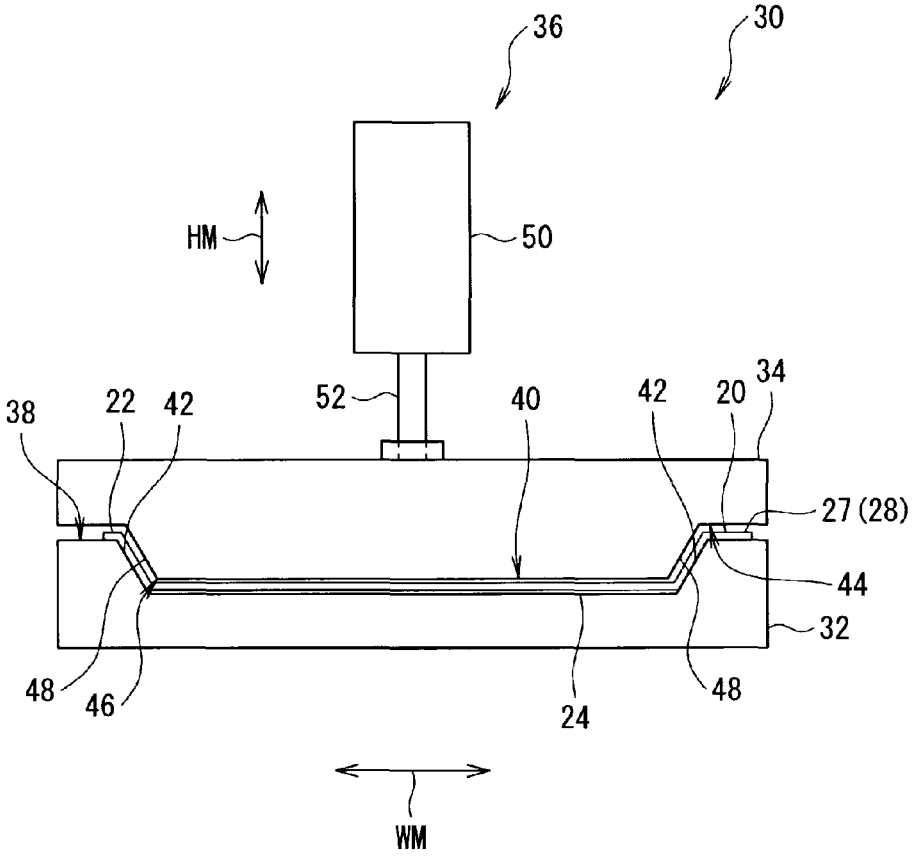
FIG. 2 is a front view of a first press forming apparatus which is an apparatus for manufacturing the closed structure part.
Figure 3:
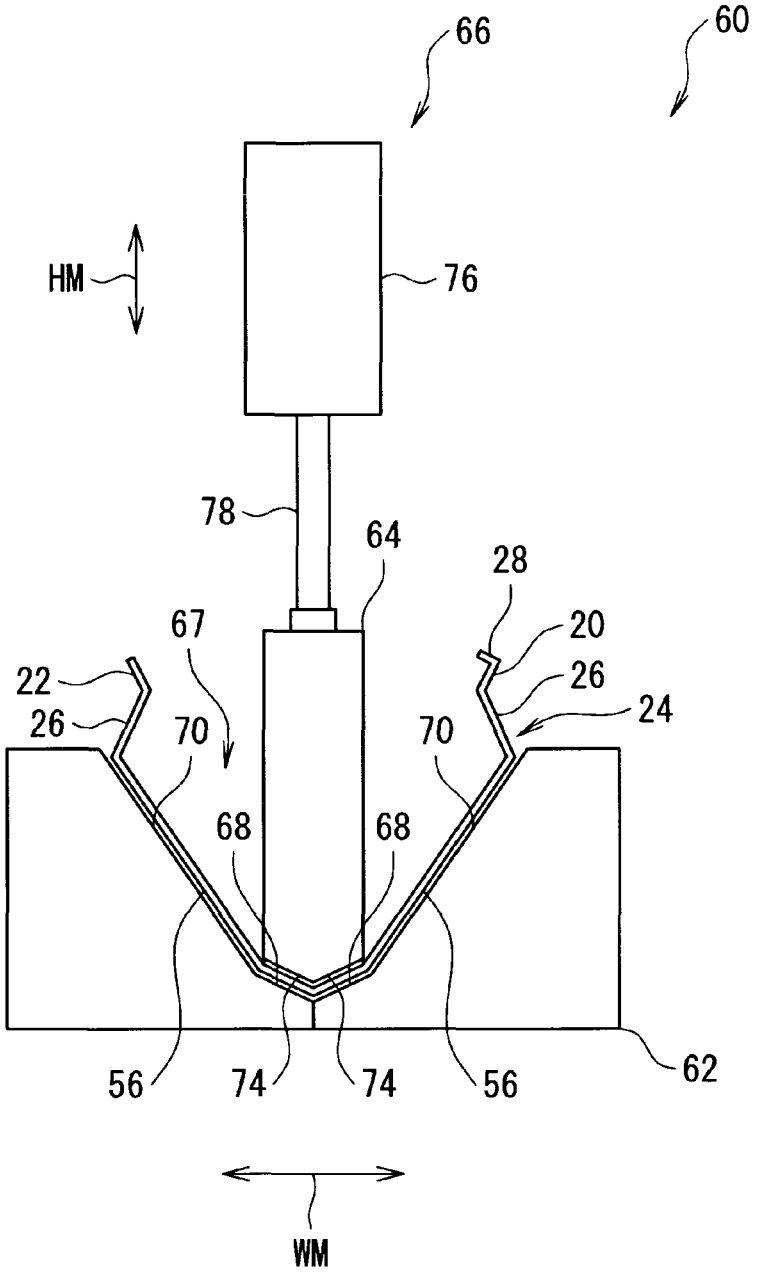
FIG. 3 is a front view of a second press forming apparatus which is an apparatus for manufacturing the closed structure part.
Figure 4:
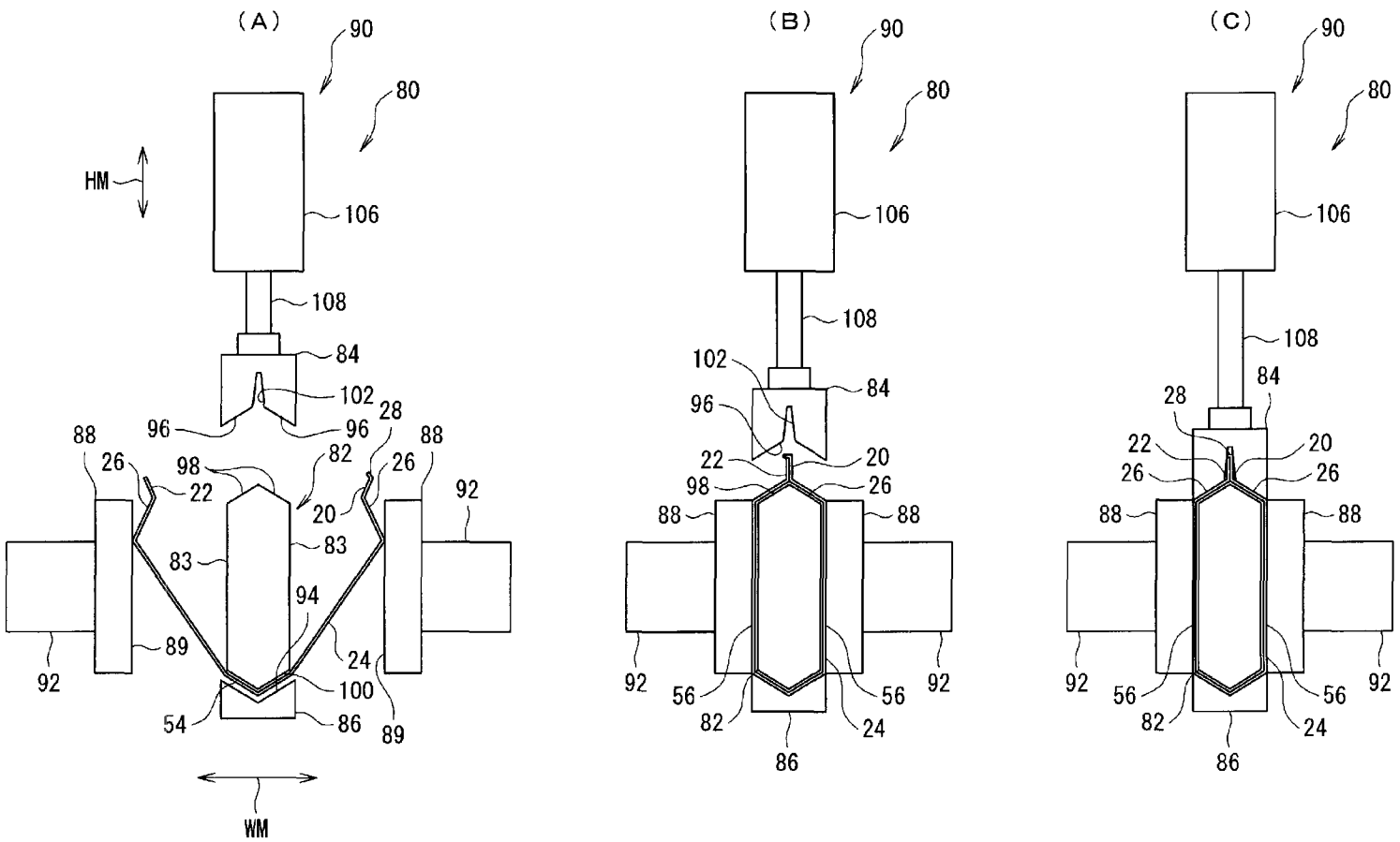
FIG. 4 is a front view of a hemming press apparatus which is an apparatus for manufacturing the closed structure part.
Figure 5:
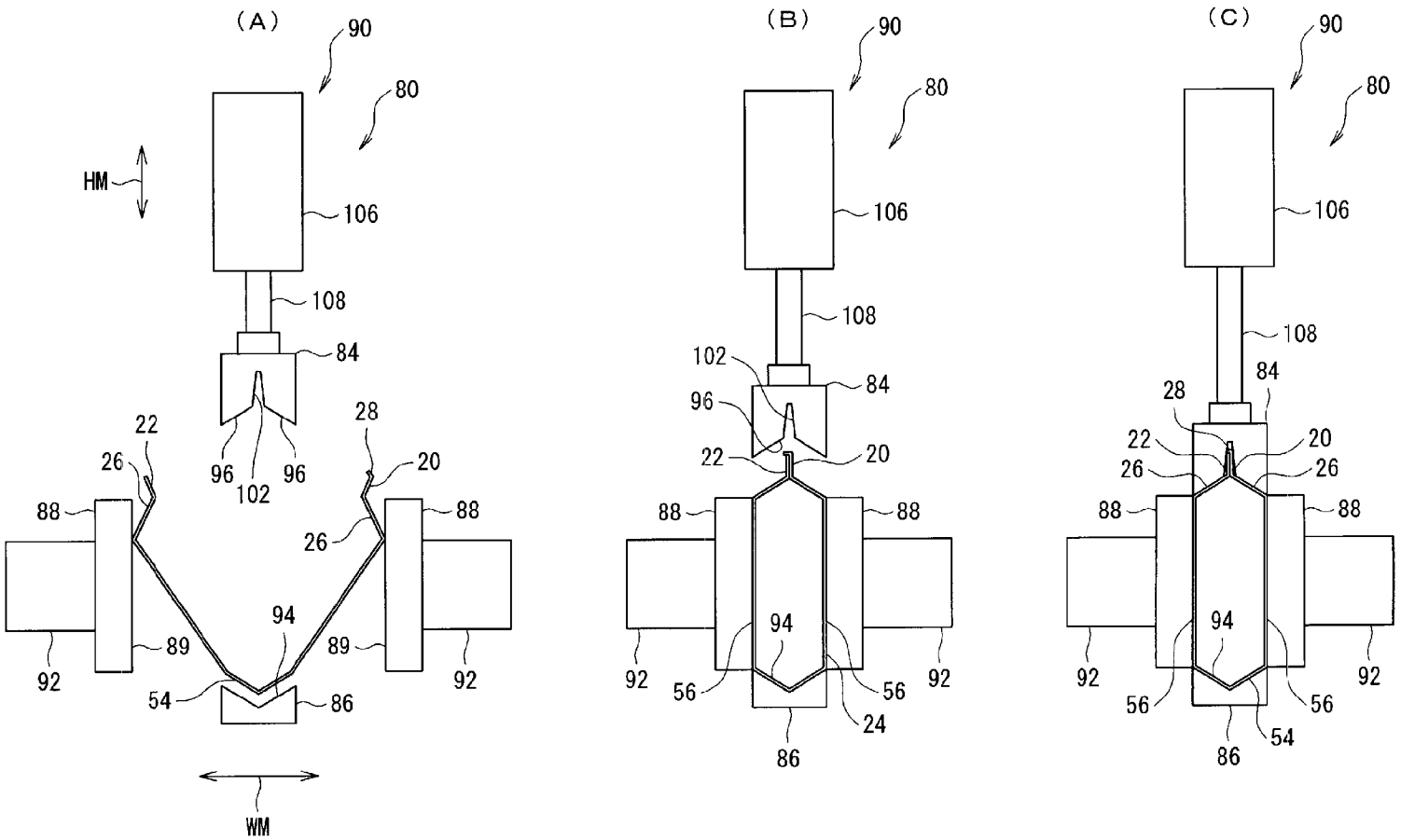
FIG. 5 is a front view of a modification of the hemming press apparatus which is an apparatus for manufacturing the closed structure part.

FIGS. 2 to 4 illustrate the structures of a first press forming apparatus, a second press forming apparatus, and a hemming press apparatus used for manufacturing a closed structure part. In addition, FIGS. 2 to 4 illustrate closed structure parts processed by these apparatuses during manufacturing. Note that a first press forming apparatus 30, a second press forming apparatus 60, and a hemming press apparatus 80 shown in FIGS. 2 to 4, respectively, are used for manufacturing the closed structure part 12 having a regular hexagonal shape in cross section (refer to FIG. 1(B)).

As shown in FIG. 2, the first press forming apparatus 30 includes a press forming die having a die 32 and a punch 34. The first press forming apparatus 30 further includes a hydraulic actuator 36 serving as driving means for driving the punch 34. The upper surface of the die 32 serves as a concave press forming surface 38. In the middle of the concave press forming surface 38 in the width direction (a direction indicated by an arrow WM), a press concave portion 40 is formed to be indented from both ends into a concave shape. The cross-sectional shape of the press concave portion 40 in the width direction is substantially trapezoidal. The press concave portion 40 includes slope surfaces 42 at either end thereof in the width direction. The slope surfaces 42 extend upwards to taper outwardly.

The lower surface of the punch 34 serves as a press forming surface 44. In the middle of the press forming surface 44 in the width direction (a direction indicated by an arrow WM), a press convex portion 46 that protrudes with respect to both ends in a convex shape is formed. The cross-sectional shape of the press convex portion 46 along the width direction is substantially trapezoidal to correspond to the cross-sectional shape of the press concave portion 40. The press convex portion 46 includes slope surfaces 48 at either end thereof in the width direction. The slope surfaces 48 correspond to the slope surfaces 42 of the press concave portion 40.

The hydraulic actuator 36 includes a cylinder 50 and a plunger 52 disposed on the inner peripheral side of the cylinder 50. The cylinder 50 is fixed to a support frame (not shown) of the first press forming apparatus 30. The plunger 52 is supported by the cylinder 50 in a slidable manner along the height direction (a direction indicated by an arrow HM). The lower end of the plunger 52 is joined to the upper middle portion of the punch 34. Under hydraulic control of a hydraulic control unit (not shown), the hydraulic actuator 36 moves the punch 34 between a press position (refer to FIG. 2) at which the press convex portion 46 of the punch 34 fits together with the press concave portion 40 of the die 32 and a standby position above the die 32.

As shown in FIG. 3, like the first press forming apparatus 30, the second press forming apparatus 60 includes a pair of a die 62 and a punch 64 making up a press forming die. The second press forming apparatus 60 further includes a hydraulic actuator 66 serving as driving means for driving the punch 64. The die 62 has a concave blank insertion portion 67 in the upper middle portion thereof that is indented from the both ends into a substantially V shape. The bottom portion of the blank insertion portion 67 has two press forming surfaces 68 formed from a pair of slope surfaces that form a concave shape. Two blank supporting surfaces 70 extend from the edges of the concave press forming surfaces 68 upwards to taper outward.

The punch 64 has a substantially rectangular shape in cross section having a length direction that coincides with the height direction (indicated by the arrow HM). The lower end surface of the punch 64 includes the press forming surfaces 74 that form a convex shape and that correspond to the press forming surfaces 68 that form a concave shape.

The hydraulic actuator 66 includes a cylinder 76 and a plunger 78 disposed on the inner peripheral side of the cylinder 76. The cylinder 76 is fixed to a support frame (not shown) of the second press forming apparatus 60. The plunger 78 is supported by the cylinder 76 in a slidable manner along the height direction. The lower end of the plunger 78 is joined to the upper middle portion of the punch 64. Under hydraulic control of a hydraulic control unit (not shown), the hydraulic actuator 66 moves the punch 64 between a press position (refer to FIG. 3) at which the press forming surface 74 of the punch 64 fits together with the press forming surface 68 of the die 62 and a standby position above the die 62.

As shown in FIG. 4(A), the hemming press apparatus 80 includes an insert core 82 having a cross section corresponding to the cross section of the main body 18 of the closed structure part 12 which is the final part (refer to FIG. 1(B)). The hemming press apparatus 80 further includes a punch 84 disposed above the insert core 82. The insert core 82 and the punch 84 serve as a press forming die. Furthermore, the hemming press apparatus 80 includes a supporting pad 86 disposed beneath the insert core 82 and two pressure cams 88 disposed at either outer end of the insert core 82 in the width direction. Still furthermore, the hemming press apparatus 80 includes a hydraulic actuator 90 serving as driving means for driving the punch 84 and a cam drive mechanism 92 that operates in conjunction with the hydraulic actuator 90.

The supporting pad 86 has a blank supporting surface 94 formed from a pair of slope surfaces that form a concave shape on the upper surface side. The shape of the blank supporting surface 94 corresponds to the shape of a bottom plate portion 54 of the main body 18. In addition, the punch 84 has two press forming surfaces 96 at either end of the punch 84 in the width direction of the lower surface. The two press forming surfaces 96 have a shape that corresponds to the shape of a shoulder portion 26 that is an outer portion of the flange portions 20 and 22.

In contrast, the insert core 82 has, as the upper surface, a press forming surface 98 formed from slope surfaces that correspond to the two press forming surfaces 96. In addition, the insert core 82 has, as a bottom surface, a convex blank supporting surface 100 that corresponds to the blank supporting surface 94 of the supporting pad 86. In addition, the side surface of each of the pressure cams 88 on an inner side in the width direction serves as a pressure surface 89 corresponding to a side portion 83 of the insert core 82.

Figure 9:
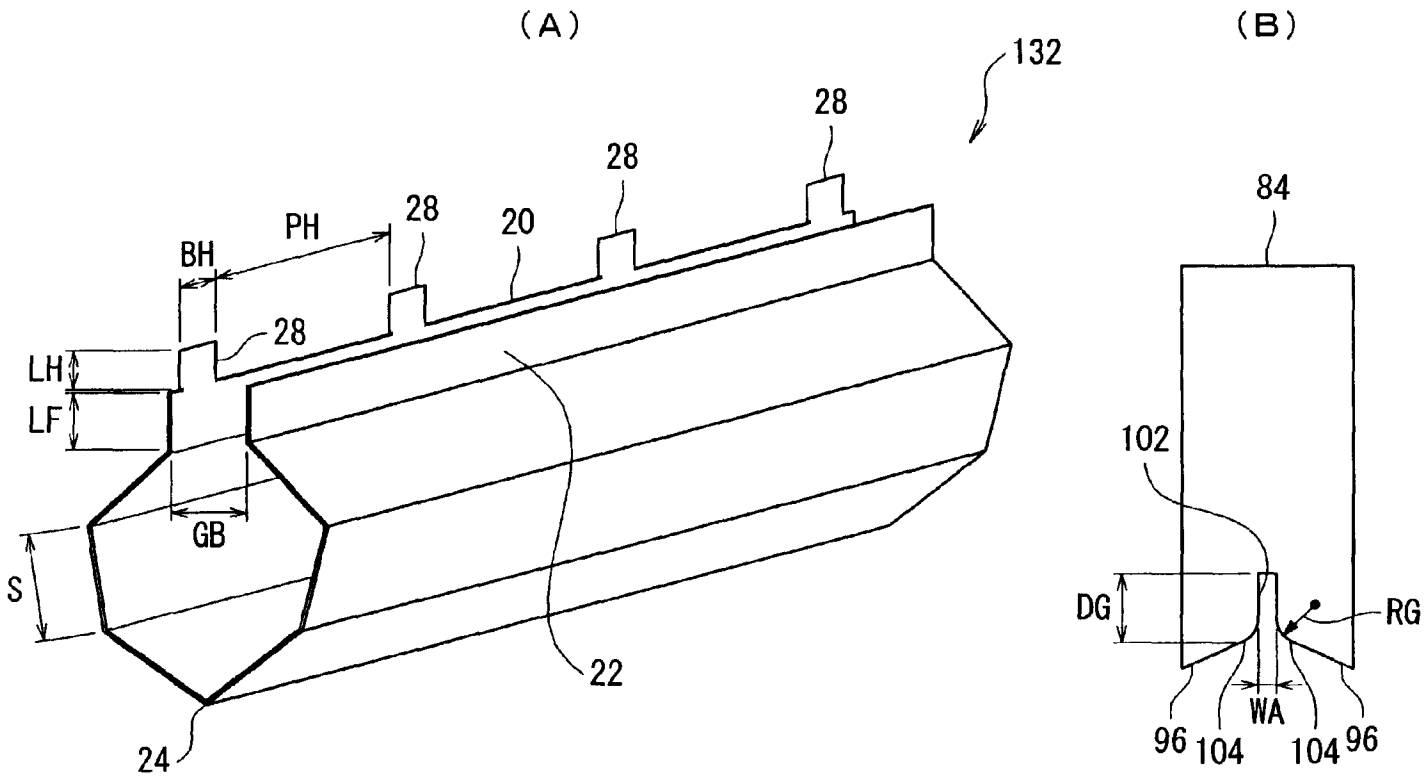
FIG. 9 is a perspective view and a front view illustrating another example of the structure of a closed structure part and a punch.

As shown in FIG. 6(A) or 9(B), the punch 84 has a slit clearance 102 in the middle portion between the two press forming surfaces 96 extending in the width direction. In addition, the punch 84 has an insert guide surface 104 between the slit clearance 102 and each of the two press forming surfaces 96. In this instance, WA denotes the opening width of the slit clearance 102 and let DG denote the depth of the slit clearance 102 with respect to the two press forming surfaces 96. Then, according to this example, the opening width WA is appropriately set to a value greater than or equal to 2 times the thickness of the high-tensile steel plate that is the material used for the closed structure part 12 and less than or equal to 10 times the thickness. In addition, the depth DG is appropriately set to a value greater than or equal to 3 mm and less than or equal to 50 mm.

Each of the two insert guide surfaces 104 is formed as a convex curved surface having a constant radius of curvature. The insert guide surface 104 smoothly connects the side end portion of the press forming surface 96 to the lower end portion of the slit clearance 102. In this instance, RG denotes the radius of curvature of the insert guide surface 104. Then, the radius of curvature RG may be 0 mm (a right angle) or may have a value greater than 0. The radius of curvature RG can be set to any value as appropriate.

The hydraulic actuator 90 includes a cylinder 106 and a plunger 108 disposed on the inner peripheral side of the cylinder 106. The cylinder 106 is fixed to a support frame (not shown) of the hemming press apparatus 80. The plunger 108 is supported by the cylinder 106 in a slidable manner along the height direction. The lower end of the plunger 108 is joined to the upper middle portion of the punch 84. Under hydraulic control of a hydraulic control unit (not shown), the hydraulic actuator 90 moves the punch 84 between a press position (refer to FIG. 4(C)) at which the press forming surface 96 of the punch 84 fits together with the press forming surface 98 of the insert core 82 and a standby position above the insert core 82.

A pair of the cam drive mechanisms 92 operates in conjunction with the operation performed by the hydraulic actuator 90. Each of the cam drive mechanisms 92 moves the pressure cam 88 between a standby position (refer to FIG. 4(A)) to which the pressure cam 88 is moved away from the side portion of the insert core 82 along the width direction and a pressure position at which the pressure cam 88 is urged against the side portion of the insert core 82 in the width direction. More specifically, when the hydraulic actuator 90 moves the punch 84 downward from the standby position to the press position, the cam drive mechanism 92 moves the pressure cam 88 from the standby position to the pressure position. In contrast, when the hydraulic actuator 90 moves the punch 84 upward from the press position to the standby position, the cam drive mechanism 92 moves the pressure cam 88 from the pressure position to the standby position.

While the above-described apparatus shown in FIGS. 2 to 5 has been described as a press forming apparatus that moves the punch using a hydraulic actuator, a press forming apparatus is not limited to such an apparatus. For example, a mechanical press machine (i.e., a widely used press machine) including a crank press can be used.

(Method for Manufacturing Closed Structure Part)

A method for manufacturing the closed structure part 12 (a method for manufacturing a closed structure part) using the above-described manufacturing apparatus is described next.

In one method for manufacturing a closed structure part, a first press step using the first press forming apparatus 30 shown in FIG. 2 is performed first. In the first press step, a blank 24 that is a high-tensile steel plate and that has been cut into a predetermined shape in advance is mounted between the press forming surface 38 of the die 32 and the press forming surface 44 of the punch 34 of the first press forming apparatus 30. Thereafter, the punch 34 located at the standby position is lowered to the press position using the hydraulic actuator 36. In this way, as shown in FIG. 2, the blank 24 is formed into a shape corresponding to the shape formed by the press forming surface 38 and the press forming surface 44 (press forming). At that time, the flange portions 20 and 22 are formed at either end of the blank 24 in the width direction. In addition, the pair of shoulder portions 26 is formed in the main body 18 by the slope surfaces 42 and 48.

In this method for manufacturing a closed structure part, a preliminary hemming step is performed using a general-purpose press forming apparatus (not shown) after the first press step has been completed. An example of the general-purpose press forming apparatus is a press forming apparatus that can bend the end portion of a planar high-tensile steel plate at a substantially right angle. In addition, as shown in FIG. 9(A), a plurality of hemming prongs 28 are formed in advance in one of the side end portions of the blank 24 corresponding to the flange portion 20, which is one of the two flange portions. A plurality of protruding portions 27 are formed to correspond to the plurality of hemming prongs 28. As shown in FIG. 2, the protruding portions 27 each having a rectangular shape are formed to protrude from the side end of the blank 24.

In this instance, PH denotes the separation distance between the protruding portions 27 in the length direction and LH denotes the protruding length of the plurality of protruding portions 27 from the side end of the blank 24. The separation distance PH is appropriately set to a value greater than or equal to 5 mm and less than or equal to a length obtained by subtracting the hemming prong widths from the product length. In addition, the protruding length LH is appropriately set to a value greater than or equal to 1 time the thickness of the blank 24 and less than or equal to 1.5 times the flange height. Furthermore, a width BH is appropriately set to a value greater than or equal to twice the thickness of the plate and less than or equal to the product length.

In the preliminary hemming step (not shown), the plurality of protruding portions 27 that are formed in the blank 24 in the first press step shown in FIG. 2 and that protrude from the top end of the flange portion 20, which is one of the two flange portions, are bent towards the flange portion 22, which is the other flange portion, at a substantially right angle. In this way, the plurality of protruding portions 27 are made into the plurality of hemming prongs 28 used for joining (hemming-joining) the flange portions 20 and 22.

In one method for manufacturing a closed structure part, a second press step using the second press forming apparatus 60 shown in FIG. 3 is performed after the preliminary hemming step has been completed. In the second press step, the blank 24 having the pair of shoulder portions 26 and the plurality of hemming prongs 28 formed therein through the first press step and the preliminary hemming step is mounted on the blank insertion portion 67 of the die 62 of the second press forming apparatus 60. Thereafter, the punch 64 located at the standby position is lowered to the press position by the hydraulic actuator 66. In this way, as shown in FIG. 3, the middle portion of the blank 24 in the width direction is formed into a shape corresponding to the shape formed by the press forming surfaces 68 and 74 (press forming). At that time, the bottom plate portion 54 of the main body 18 is formed in the middle of the blank 24 in the width direction. In addition, a portion of the blank 24 between each of the shoulder portions 26 and the bottom plate portion 54 is made into a side plate portion 56. Each of the two side plate portions 56 is supported by one of the two blank supporting surfaces 70 and is bent at a predetermined tilt angle with respect to the bottom plate portion 54.

In one method for manufacturing a closed structure part, a closing step and a press hemming step are performed using the hemming press apparatus 80 after the second press step has been completed. In the closing step and press hemming step, as shown in FIG. 4(A), the bottom plate portion 54 of the blank 24 is sandwiched between the blank supporting surface 94 of the supporting pad 86 and the blank supporting surface 100 of the insert core 82. At that time, the pressure surface 89 of each of the pressure cams 88 located at the standby position is brought into contact with the blank 24 at a position in the vicinity of the border between the shoulder portions 26 and the side plate portion 56.

Subsequently, as shown in FIG. 4(B), each of the pressure cams 88 located at the standby position is moved towards the pressure position using the cam drive mechanism 92. Thus, each of the side plate portions 56 is moved (bent) towards the side portion 83 of the insert core 82 and is urged against the side portion 83 by the pressure surface 89 of the pressure cam 88. At the same time, the punch 84 located at the standby position is lowered towards the press position by using the hydraulic actuator 90. The top ends of the flange portions 20 and 22 are moved towards the slit clearance 102 along the two press forming surfaces 96 and the two insertion guide surfaces of the punch 84.

As shown in FIG. 4(C), when each of the two pressure cams 88 is moved to the pressure position and if each of the two side plate portions 56 is urged against the side portion 83 of the insert core 82 by one of the two pressure surfaces 89, the flange portions 20 and 22 are substantially closed along the width direction. Thereafter, the punch 84 located between the standby position and the press position is lowered to the press position by the hydraulic actuator 90. In this way, the plurality of hemming prongs 28 and the flange portions 20 and 22 are inserted into the slit clearance 102. At that time, upon being inserted into the slit clearance 102, the top ends of the plurality of hemming prongs 28 are in pressure contact with the inner surface portion of the slit clearance 102. Thus, as the punch 84 is further lowered, the hemming prongs 28 are further bent downward about the border portion with the flange portion 20 by the downward pressing force transferred via the inner surface portion of the slit clearance 102. In this way, each of the hemming prongs 28 sandwiches the top portion of the flange portion 22, which is the other flange portion. As a result, the flange portion 20, one of the two flange portions, is joined to the flange portion 22 via the plurality of hemming prongs 28 (hemming joint).

In one method for manufacturing a closed structure part, after the hemming press step has been completed, a welding step is performed using a general-purpose welding apparatus, such as a spot welding apparatus, a laser welding apparatus, or an arc welding apparatus. During the welding step, the flange portions 20 and 22 joined using the hemming prongs 28 are welded together using spot welding, laser welding, or arc welding. Thereafter, if, like a part, such as a front side member, the flange portions are not used for another purpose, the top end of the welded portion of the flange portions 20 and 22 is cut off by shearing or meltdown to further reduce the weight. However, for a portion (e.g., a locker) that needs to be joined to another part (joining of the locker and a floor in the case of the locker), the flange portion is not cut off and can be used as a joint flange for joining another part. Thus, the closed structure part 12 shown in FIG. 1(B) is manufactured.

Note that the closed structure parts 10, 14, and 16 other than the closed structure part 12 can be manufactured through the steps that are substantially the same as those for the closed structure part 12 by simply mounting the dies 32 and 62, the punches 34, 64, and 84, the supporting pad 86, the pressure cams 88, and the insert core 82 that correspond to the shape of the closed structure part to be manufactured into the first press forming apparatus 30, the second press forming apparatus 60, and the hemming press apparatus 80 and appropriately adjusting, for example, the strokes of the hydraulic actuators 36, 66, and 90 and the cam drive mechanism 92.

In addition, as shown in FIGS. 4(A) to 4(C), the hemming press apparatus 80 includes the insert core 82 and the punch 84 serving as a press forming die. The press joining apparatus 80 performs the hemming press step using the insert core 82 and the punch 84 in addition to the supporting pad 86 and the pair of pressure cams 88. However, if slightly low dimension accuracy and a slightly low accuracy of the shape of the closed structure parts 10 to 16 are allowed or if the blank 24 having an excellent plastic formability is used, the hemming press step (press forming and hemming) can be performed using only the punch 84, the supporting pad 86, and the pair of pressure cams 88 without using the insert core 82 in the hemming press apparatus 80 and without supporting the blank 24 by the insert core 82 from inside, as shown in FIGS. 5(A) to 5(C).

Figure 6:
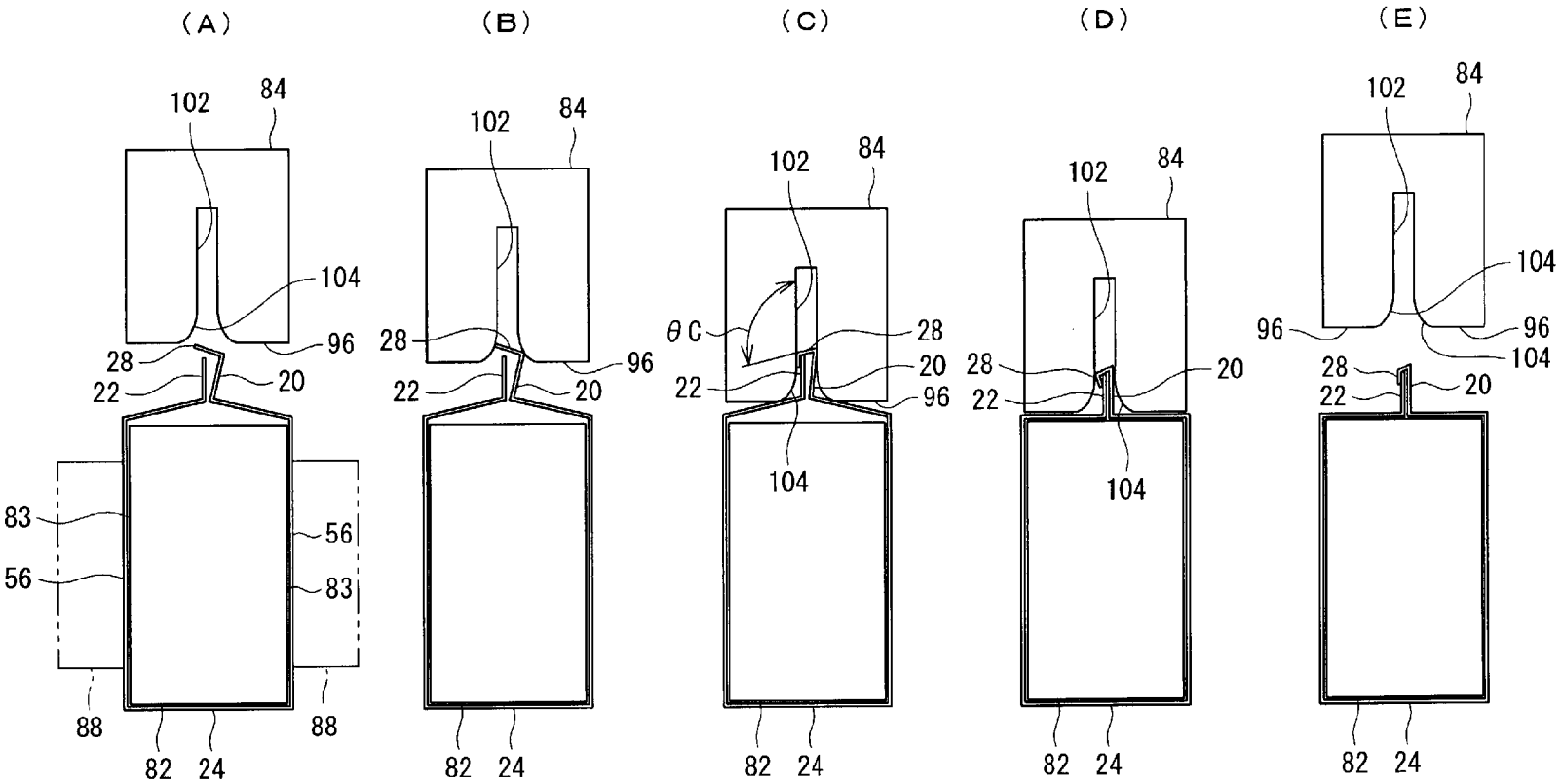
FIG. 6 is a front view of an insert core and a punch used in a hemming press step performed by the hemming press apparatus.
Figure 7:
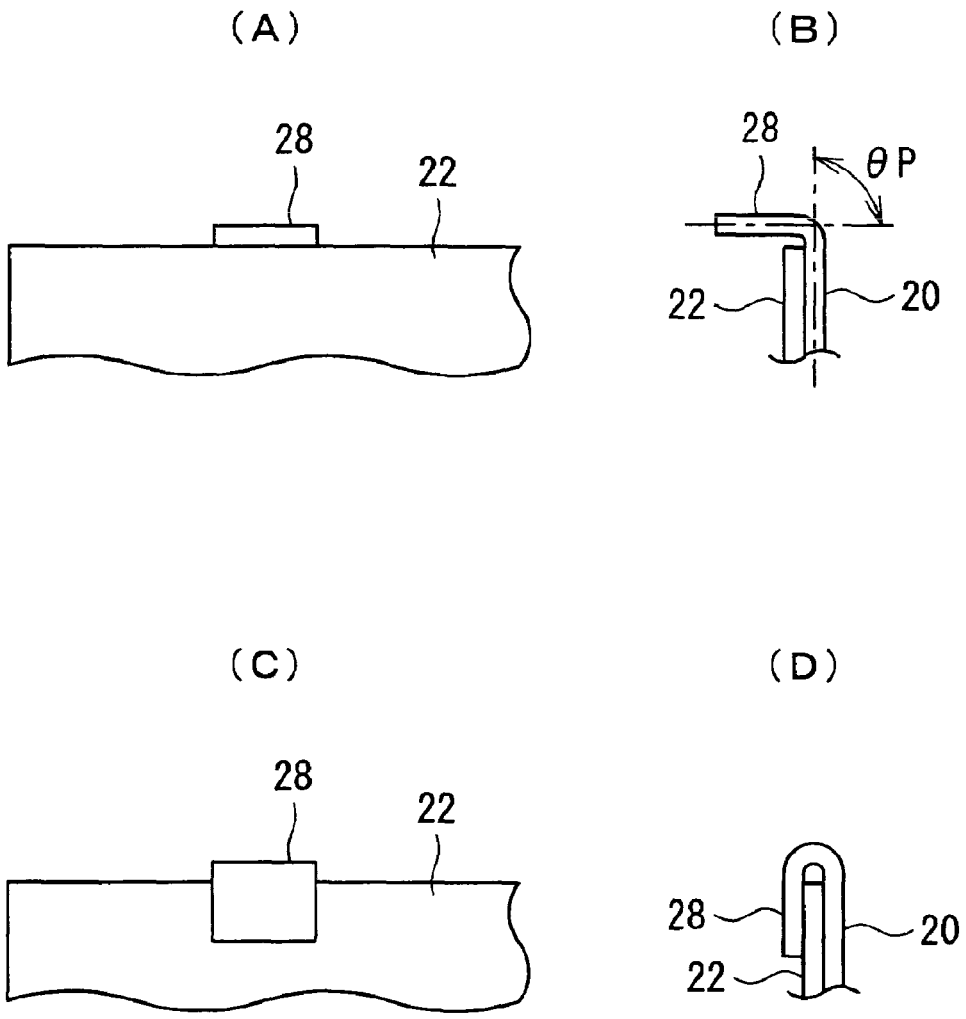
FIG. 7 is a front view and a side view of the structures of a flange portion and a hemming prong of a closed structure part.

The hemming press step of one method for manufacturing a closed structure part is described in more detail next with reference to FIGS. 6 and 7. Note that in this example, the hemming press step used when the closed structure part 10 shown in FIG. 1(A) is manufactured from the blank 24 is described.

As described above, through the preliminary hemming step, the plurality of hemming prongs 28 protruding from the top end of the flange portion 20, which is one of the two flange portions, are bent towards the flange portion 22, as shown in FIGS. 7(A) and 7(B). At that time, it is desirable that an angle θP formed by the flange portion 20 and the plurality of hemming prongs 28 be 90° or an angle slightly larger than 90°. That is, if the angle θP is smaller than 90°, the hemming prongs 28 that are preliminarily bent cannot be in the state shown in FIG. 7(D) with respect to the other flange portion 22.

In the closing step and the hemming press step, as shown in FIG. 6(A), before the press forming surfaces 96 of the punch 84 are brought into contact with the blank 24, the two side plate portions 56 of the blank 24 are urged against the side portions 83 of the insert core 82 by the pressure cams 88. Thus, the distance between the top portions of the flange portions 20 and 22 is made smaller than a distance between the outer ends of the two insert guide surfaces 104 of the punch 84.

Subsequently, as shown in FIG. 6(B), when the punch 84 is lowered by the hydraulic actuator 90, the top end of the flange portion 20 is brought into contact with the two insert guide surfaces 104 and, thus, receives a pressing force from the insert guide surface 104. At that time, since the insert guide surface 104 is tilted with respect to a direction in which the punch 84 moves (a pressing direction) and the width direction (a direction perpendicular to the pressing direction), a force component acts on the top portions of the flange portions 20 and 22 so that the top portions are brought closer to each other in the width direction. The flange portions 20 and 22 are brought closer to each other due to this force component.

As shown in FIG. 6(C), if the punch 84 is further lowered, the top end portions of the flange portions 20 and 22 and the hemming prongs 28 are inserted into the slit clearance 102. At that time, the top ends of the hemming prongs 28 are in pressure contact with the inner surface portion of the slit clearance 102 at a predetermined contact angle θC. At that time, the contact angle θC is larger than 90°. Accordingly, a large friction resistance occurs between each of the top ends of the hemming prongs 28 and the inner surface portion of the slit clearance 102.

As shown in FIG. 6(D), if the punch 84 is lowered from the position shown in FIG. 6(C) to the press position, each of the two shoulder portions 26 of the blank 24 is formed into a predetermined shape by one of two press forming surfaces 96 of the punch 84 and one of the two press forming surfaces 98 of the insert core 82. At the same time, the hemming prongs 28 are bent downwards about the border portion with the flange portion 20 due to the friction force (the pressing force) transferred from the inner surface portion of the slit clearance 102. In this way, as shown in FIGS. 7(C) and 7(D), each of the plurality of hemming prongs 28 sandwiches the top portion of the other flange portion 22. Thus, the flange portion 20, which is one of the two flange portions, is joined to the other flange portion 22 via the plurality of hemming prongs 28 (hemming joint).

If the flange portions 20 and 22 are joined together by hemming, the hemming press apparatus 80, as shown in FIG. 6(E), raises the punch 84 from the press position to the standby position by using the hydraulic actuator 90. Thereafter, the hemming press apparatus 80 moves the insert core 82 away from the blank 24 (the main body 18) along the length direction of the closed structure part 10. In this way, the form of the closed structure part 10 having a closed section is achieved. The flange portions 20 and 22 of the blank 24 processed in one hemming press step are welded, and the top ends of the flange portions 20 and 22 are cut off to reduce the weight of the closed structure part 10. Thus, manufacturing of the closed structure part 10 serving as a component is completed. However, if the closed structure part is used as a structural part that does not receive an excessive load or as a part that may be deformed or destroyed, the blank 24 processed in the hemming press step may be directly used as a closed structure part (a finished part).

(Operations)

In one method for manufacturing a closed structure part, after the preliminary hemming step has been completed, the closing step is performed. In the closing step, the two insert guide surfaces 104 of the punch 84 are urged against the top end of the flange portion 20, and the punch 84 is lowered towards the press position. Thus, the flange portions 20 and 22 are brought closer to each other due to a force component generated by each of the two insert guide surfaces 104, and the flange portions 20 and 22 are guided into the slit clearance 102 of the punch 84. In this way, the flange portions 20 and 22 can be brought closer to each other against the deformation resistance (springback) of the blank 24, and the distance between the flange portions 20 and 22 can be set to correspond to the opening width WA of the slit clearance 102. Accordingly, if the opening width WA of the slit clearance 102 is appropriately determined in accordance with the allowable value for the distance between the flange portions 20 and 22, the distance between the flange portions 20 and 22 can be sufficiently reduced and can be maintained in the slit clearance 102.

In addition, in one method for manufacturing a closed structure part, after the closing step has been completed, the punch 84 is further lowered towards the press position in the hemming press step. Thus, the flange portions 20 and 22 are inserted into the slit clearance 102 and the hemming prongs 28 are bent to sandwich the flange portion 22. In this way, the flange portion 20, which is one of the two flange portions, is joined to the other flange portion 22. At the same time, the metal plate is pressurized by the two press forming surfaces 96 of the punch 84 and, thus, the two shoulder portions 26 of the blank 24 are press-formed into a predetermined shape. Accordingly, the distance between the flange portions 20 and 22 can be sufficiently decreased. Thereafter, the flange portion 20 can be fixed to the flange portion 22 using the hemming prongs 28 (hemming joint). At the same time, the two shoulder portions 26 of the blank 24 can be press-formed into a predetermined shape.

Thus, in one method for manufacturing a closed structure part, a single high-tensile steel plate serving as the blank 24 can be manufactured into any one of the closed structure parts 10 to 16. In addition, the hemming joint operation of the flange portions 20 and 22 of one of the closed structure parts 10 to 16 and the press-forming operation of the two shoulder portions 26 of the blank 24 can be performed at the same time. Accordingly, the number of sub-parts of each of the closed structure parts 10 to 16 and the number of steps for manufacturing the closed structure part can be reduced and, therefore, the closed structure parts 10 to 16 can be efficiently manufactured.

In addition, according to the hemming press apparatus 80, which is one apparatus for manufacturing the closed structure part, a single metal plate serving as the blank 24 is mounted on the insert core 82 and the punch 84. The punch 84 is lowered from the standby position to the press position using the hydraulic actuator 90. Thus, the distance between the flange portions 20 and 22 can be sufficiently reduced in the slit clearance 102. Thereafter, the flange portion 20, which is one of the two flange portions, can be fixed to the flange portion 22 using the hemming prongs 28 (hemming joint). At the same time, the two shoulder portions 26 of the blank 24 can be press-formed into a predetermined shape. Accordingly, any one of the closed structure parts 10 to 16 having a closed section can be manufactured using the single metal plate serving as the blank 24. In addition, the hemming joint operation of the flange portions 20 and 22 of each of the closed structure parts 10 to 16 and the press-forming operation of the two shoulder portions 26 of the blank 24 can be performed at the same time. Accordingly, the number of sub-parts of each of the closed structure parts 10 to 16 and the number of steps for manufacturing the closed structure part can be reduced and, therefore, the closed structure parts 10 to 16 can be efficiently manufactured.

Furthermore, according to one of the closed structure parts 10 to 16, the main body 18, the two flange portions 20 and 22, and the hemming prongs 28 are formed from a single high-tensile steel plate (the blank 24). Hemming is performed so that the hemming prongs 28 protruding from the top portion of the flange portion 20, which is one of the two flange portions, sandwich the other flange portion 22. Thus, the flange portion 20 is fixed to the flange portion 22 (hemming joint). In this way, the main body 18, the flange portions 20 and 22, and the hemming prongs 28, which are main components of each of the closed structure parts 10 to 16, can be integrally formed from the single blank 24. In addition, joint ends of the main body 18 can be joined together using only the flange portions 20 and 22 so that the main body 18 can have closed section. Accordingly, the number of sub-parts of each of the closed structure parts 10 to 16 can be reduced, and the ratio of the weight of the flange portions 20 and 22 to the entire weight of the closed structure part can be reduced, as compared with a closed structure part including two or more independent sub-parts. Thus, the weight of each of the closed structure parts 10 to 16 can be efficiently reduced.

EXAMPLES (Hemming Press Apparatus)

The dimensions of the main components of the punch 84 of the hemming press apparatus 80 and the reason for selecting the dimensions are described next as an example.

As described above, the opening width WA of the slit clearance 102 of the punch 84 is appropriately set to a value greater than or equal to twice the thickness of the blank 24 that is the material used for the closed structure part 10 and less than or equal to ten times the thickness. This is because if the opening width WA is set to a value less than twice the thickness of the blank 24, the friction resistance between the slit clearance 102 and each of the flange portions 20 and 22 is excessively increased when the punch 84 is lowered and, therefore, fracturing or cracking may occur in the blank 24. In contrast, if the opening width WA is set to a value greater than ten times the thickness of the blank 24, the hemming prongs 28 cannot be urged against the other flange portion 22 in hemming even if the punch 84 is lowered to the press position. Thus, a gap may be formed between the flange portions 20 and 22 (backlash may occur).

In addition, the depth DG of the slit clearance 102 of the punch 84 is appropriately set to a value greater than or equal to 3 mm and less than or equal to 50 mm. This is because the depth DG of the slit clearance 102 needs to be greater than the protruding length of each of the flange portions 20 and 22. If the depth DG is set to a value less than 3 mm, the height of each of the flange portions 20 and 22 is too small and, thus, it is difficult to join the flange portions 20 and 22 together by welding after the hemming joint is performed. In contrast, if the depth DG is set to a value greater than 50 mm, it is difficult to maintain the stiffness of the punch 84.

(Hemming Prong)

The dimensions of the hemming prongs 28 of each of the closed structure parts 10 to 16 and the reason for selecting the dimensions are described next as an example.

As described above, the protruding length LH of the hemming prongs 28 is appropriately set to a value greater than or equal to 1 time the thickness of the blank 24 and less than or equal to 1.5 times the flange height. This is because if the protruding length LH is less than 1 time the thickness of the blank 24, it is difficult to sufficiently increase the joint strength between the flange portions 20 and 22 that are joined using the hemming prongs 28. Thus, it is difficult to reliably join the flange portions 20 and 22 together by hemming. In contrast, if the protruding length LH is greater than 1.5 times the flange height, the ratio of the weight of the hemming prongs 28 to the entire weight of each of the closed structure parts 10 to 16 becomes too large. Thus, the weight of each of the closed structure parts 10 to 16 is disadvantageously increased.

In addition, the separation distance PH of the hemming prongs 28 is appropriately set to a value greater than or equal to 5 mm and less than or equal to a length obtained by subtracting the hemming prong widths from the product length. This is because if the separation distance PH is less than 5 mm, the ratio of the weight of the plurality of hemming prongs 28 to the entire weight of each of the closed structure parts 10 to 16 is excessively increased and, therefore, the weight of each of the closed structure parts 10 to 16 is increased. In addition, the separation distance PH can be less than or equal to a length obtained by subtracting the length of the hemming prong from the product length.

If the hemming prong width is less than 2 times the thickness of the plate, it is difficult to sufficiently increase the joint strength between the flange portions 20 and 22 and, therefore, it is difficult to reliably join the flange portions 20 and 22 together by hemming. In addition, the hemming prong width can be smaller than or equal to the product length.

Examples and Comparative Examples of Closed Structure Part

Closed structure parts manufactured using the method for manufacturing a closed structure part are described next as Examples 0 to 4. In addition, closed structure parts manufactured using a method for manufacturing a closed structure part that does not meet our conditions are described below as comparative examples 1 to 4.

Figure 10:
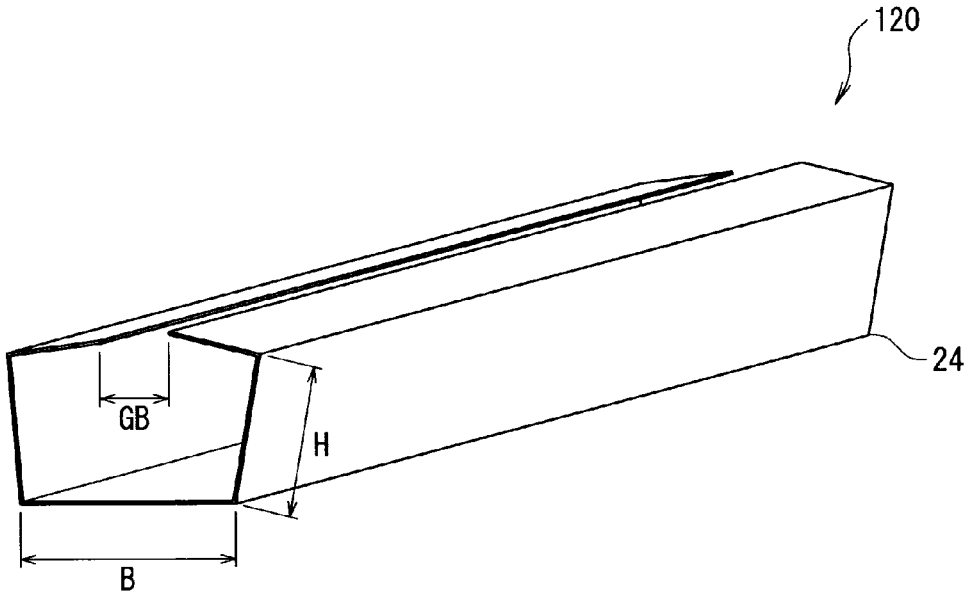
FIG. 10 is a perspective view illustrating a comparative example of the structure of a closed structure part.

In comparative example 1, a cold-rolled steel having a thickness of 1.2 mm and a tensile strength of 1180 MPa is employed as the blank 24. Such a blank 24 is subjected to a process performed in a hemming press step using the hemming press apparatus 80. Thus, as shown in FIG. 10, a closed structure part 120 serving as an interim part is formed (press-formed).

The closed structure part 120 has a substantially rectangular cross section. A width B of the closed structure part 120 is 120 mm. A height H of the closed structure part 120 is 80 mm. The entire length of the closed structure part 120 is 800 mm. However, the closed structure part 120 does not have the two flange portions and hemming prongs. Accordingly, even when the hemming press step is performed on the blank 24, hemming is not performed on hemming prongs. Accordingly, the presence or absence of the insert guide surface 104 and the slit clearance 102 in the punch 84 has no impact on, for example, the shape of the closed structure part 120.

Figure 11:
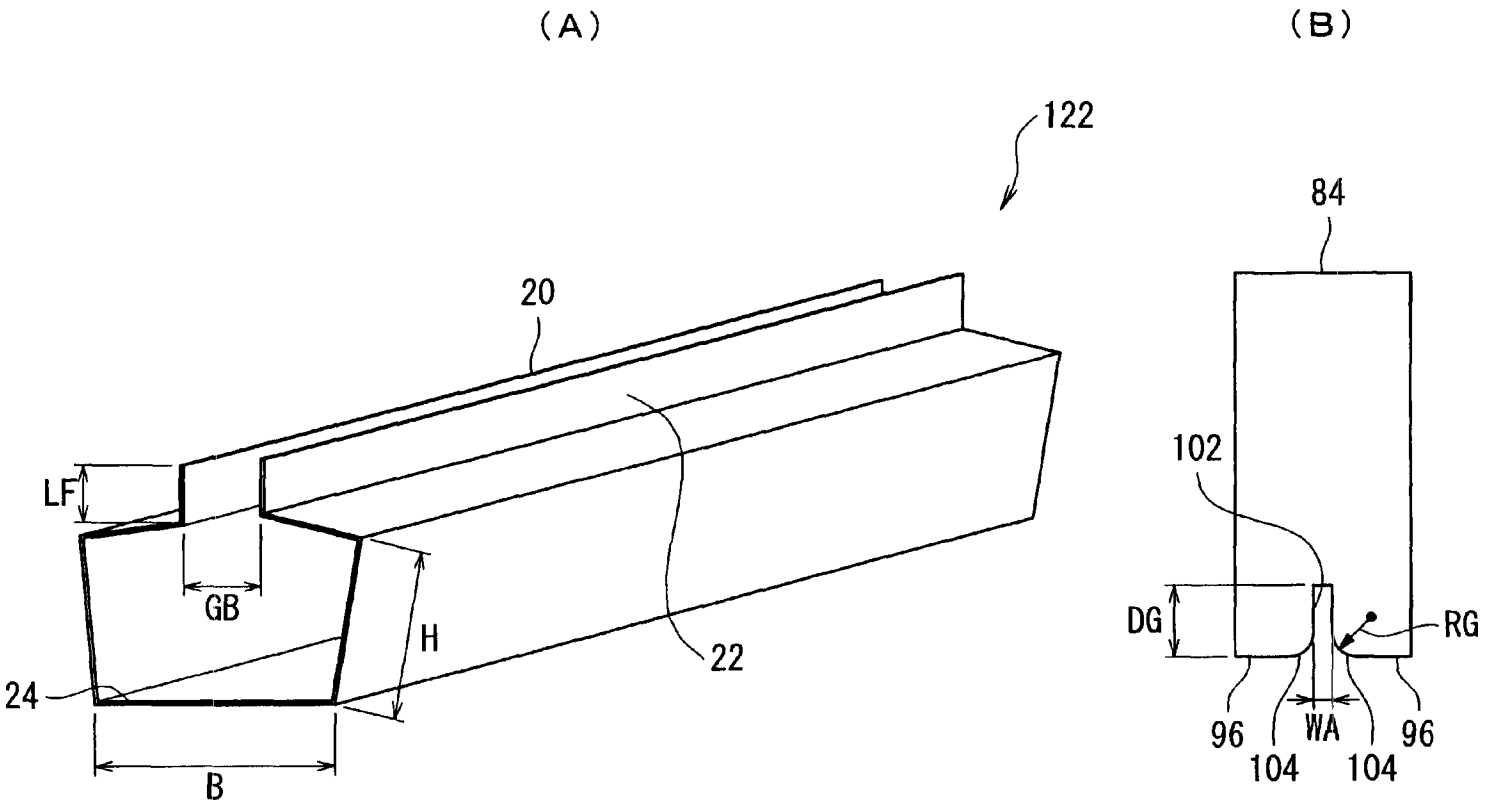
FIG. 11 is a perspective view and a front view illustrating another comparative example of the structure of a closed structure part and a punch.

In addition, in comparative example 2, a cold-rolled steel having a thickness of 1.2 mm and a tensile strength of 1180 MPa is employed as the blank 24. Such a blank 24 is subjected to the processes in the closing step and hemming press step using the hemming press apparatus 80. Thus, as shown in FIG. 11(A), a closed structure part 122 serving as an interim part is formed (press-formed).

The closed structure part 122 has a substantially rectangular cross section. A width B of the closed structure part 122 is 120 mm. A height H of the closed structure part 122 is 80 mm. The entire length of the closed structure part 122 is 800 mm. In addition, the protruding length LF of the flange portions 20 and 22 is set to 15 mm. However, the closed structure part 122 does not have a hemming prong. Accordingly, when the closing step and hemming press step are performed on the blank 24, the closing process for bringing the flange portions 20 and 22 close to each other is performed. However, hemming is not performed on hemming prongs.

In addition, the punch 84 including the slit clearance 102 having a depth DG of 30 mm and an opening width WA of 5 mm and the insert guide surfaces 104 having a radius of curvature RG of 30 mm is employed.

In contrast, in comparative example 3, a cold-rolled steel having a thickness of 1.2 mm and a tensile strength of 1180 MPa is employed as the blank 24. Such a blank 24 is subjected to the processes performed by the hemming press apparatus 80 in the closing step and the hemming press step. Thus, as shown in FIG. 12(A), a closed structure part 124 serving as an interim part is formed (press-formed).

The closed structure part 124 has a substantially rectangular cross section. A width B of the closed structure part 124 is 120 mm. A height H of the closed structure part 124 is 80 mm. The entire length of the closed structure part 124 is 800 mm. In addition, the protruding length LF of the flange portions 20 and 22 is set to 15 mm. The flange portion 20, which is one of the two flange portions, integrally includes a plurality of hemming prongs 28 protruding from the top portion of the flange portion 20. The hemming prongs 28 are processed in a preliminary hemming step before the blank 24 is mounted in the hemming press apparatus 80 and are preliminary bent.

Herein, the width BH of the hemming prong 28 is set to 10 mm. The protruding length LH of the hemming prongs 28 is also set to 10 mm. In addition, the separation distance PH of the hemming prongs 28 is set to 250 mm.

Figure 12:
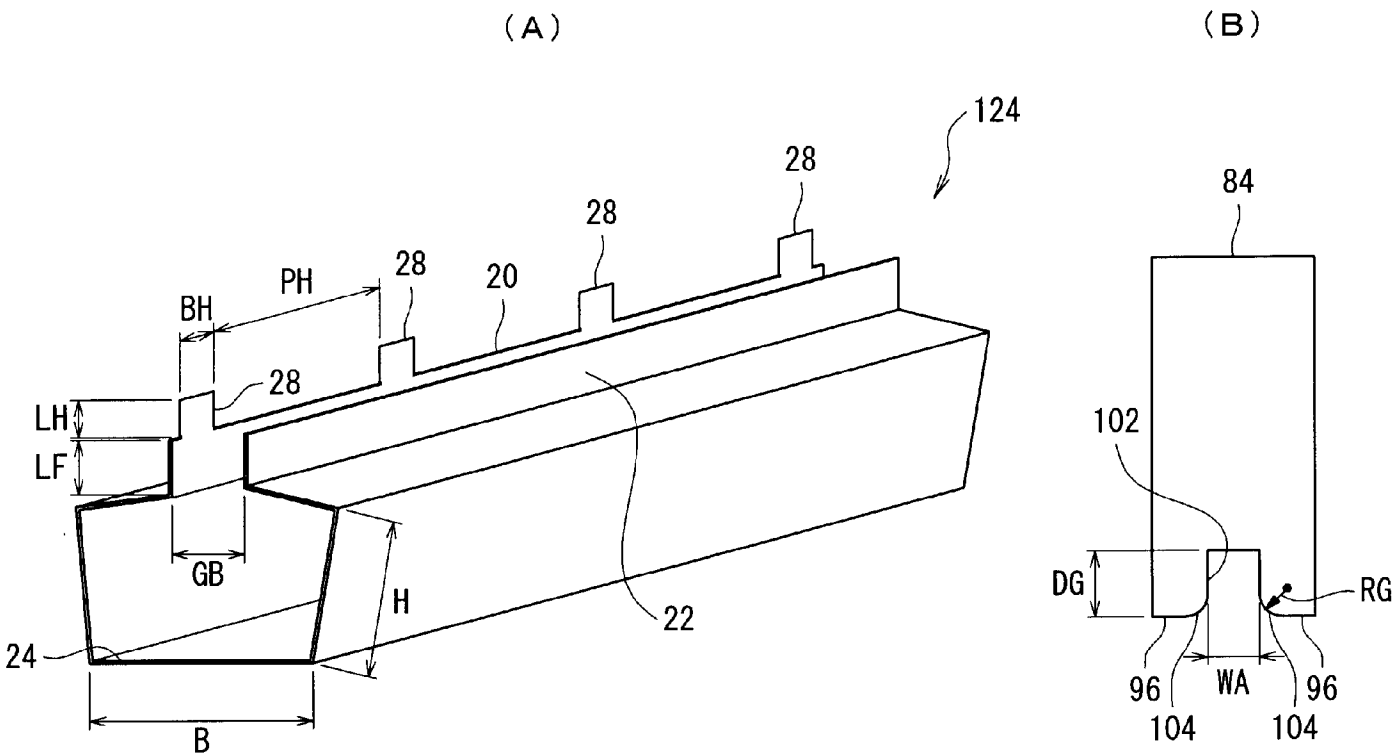
FIG. 12 is a perspective view and a front view illustrating yet another comparative example of the structure of a closed structure part and a punch.

In addition, as shown in FIG. 12(B), the punch 84 including the slit clearance 102 having a depth DG of 30 mm and an opening width WA of 20 mm and the insert guide surfaces 104 having a radius of curvature RG of 30 mm is employed. In this case, the opening width WA is about 17 times the thickness of the blank 24. That is, the opening width WA is out of the appropriate range (the range greater than or equal to 2 times and less than or equal to 10 times the thickness of the blank 24).

In contrast, in comparative example 4, a cold-rolled steel having a thickness of 1.2 mm and a tensile strength of 1180 MPa is employed as the blank 24. Such a blank 24 is subjected to the processes performed by the hemming press apparatus 80 in the closing step and the hemming press step. Thus, as shown in FIG. 13(A), a closed structure part 126 serving as an interim part is formed (press-formed).

The closed structure part 126 has a substantially rectangular cross section. A width B of the closed structure part 126 is 120 mm. A height H of the closed structure part 126 is 80 mm. The entire length of the closed structure part 126 is 800 mm. In addition, the protruding length LF of the flange portions 20 and 22 is set to 15 mm. The flange portion 20, which is one of the two flange portions, integrally includes a plurality of hemming prongs 28 protruding from the top portion of the flange portion 20. The hemming prongs 28 are processed in a preliminary hemming step before the blank 24 is mounted in the hemming press apparatus 80 and are preliminary bent.

Herein, the width BH of the hemming prong 28 is set to 10 mm. The protruding length LH of the hemming prongs 28 is set to 1 mm. In addition, the separation distance PH of the hemming prongs 28 is set to 780 mm.

Figure 13:
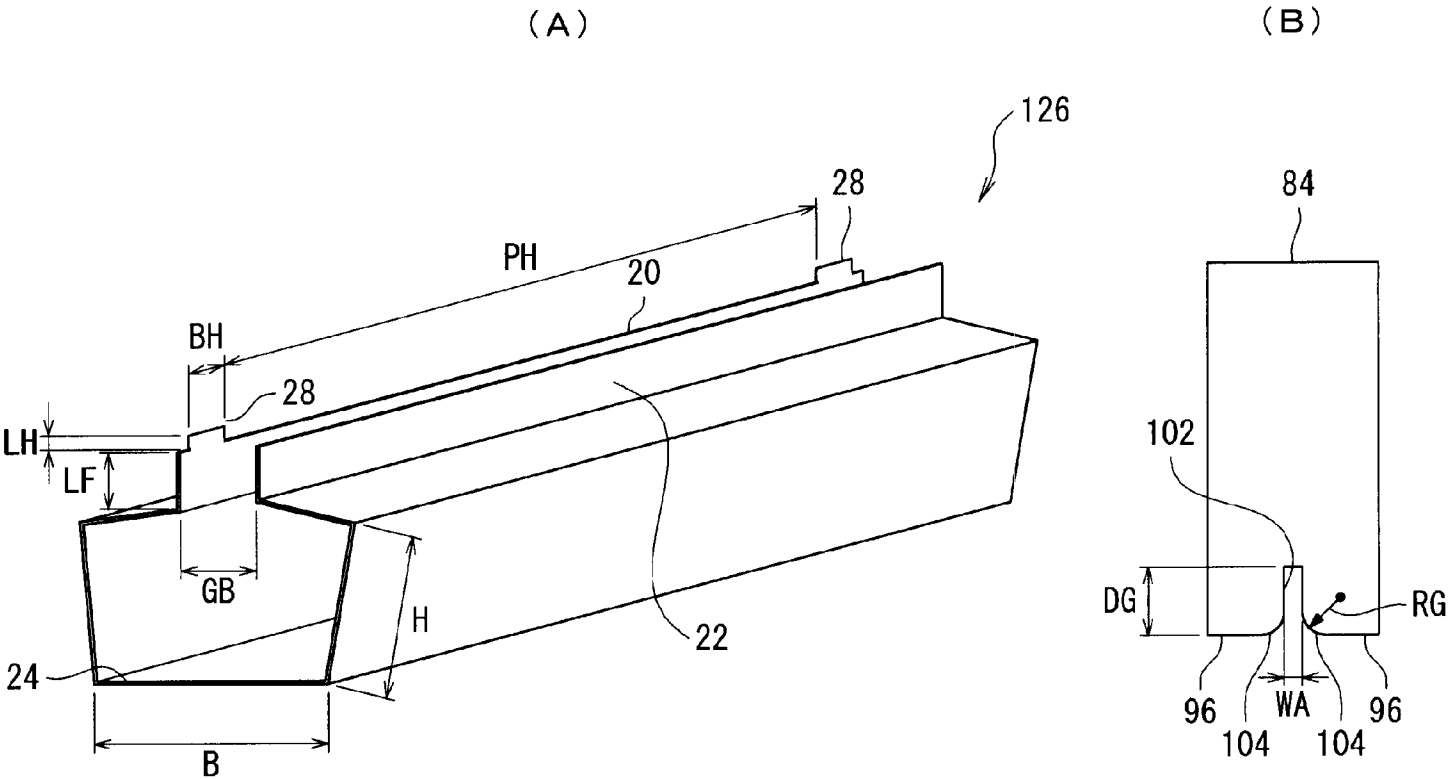
FIG. 13 is a perspective view and a front view illustrating still another comparative example of the structure of a closed structure part and a punch.

In addition, as shown in FIG. 13(B), the punch 84 including the slit clearance 102 having a depth DG of 30 mm and an opening width WA of 5 mm and the insert guide surfaces 104 having a radius of curvature RG of 30 mm is employed.

In contrast, in comparative example 0, a cold-rolled steel having a thickness of 1.2 mm and a tensile strength of 1180 MPa is employed as the blank 24. Such a blank 24 is subjected to the processes performed by the hemming press apparatus 80 in the closing step and the hemming press step. Thus, as shown in FIG. 14(A), a closed structure part 128 serving as an interim part is formed (press-formed).

The closed structure part 128 has a substantially regular hexagonal cross section. The length of a side S of the hexagonal cross section is 40 mm. The entire length of the closed structure part 128 is 800 mm. In addition, the protruding length LF of the flange portions 20 and 22 is set to 15 mm. The flange portion 20, which is one of the two flange portions, integrally includes a plurality of hemming prongs 28 protruding from the top portion of the flange portion 20. The hemming prongs 28 are processed in a preliminary hemming step before the blank 24 is mounted in the hemming press apparatus 80 and are preliminary bent.

Herein, the width BH of the hemming prong 28 is set to 10 mm. The protruding length LH of the hemming prongs 28 is set to 10 mm. In addition, the separation distance PH of the hemming prongs 28 is set to 250 mm.

Figure 14:
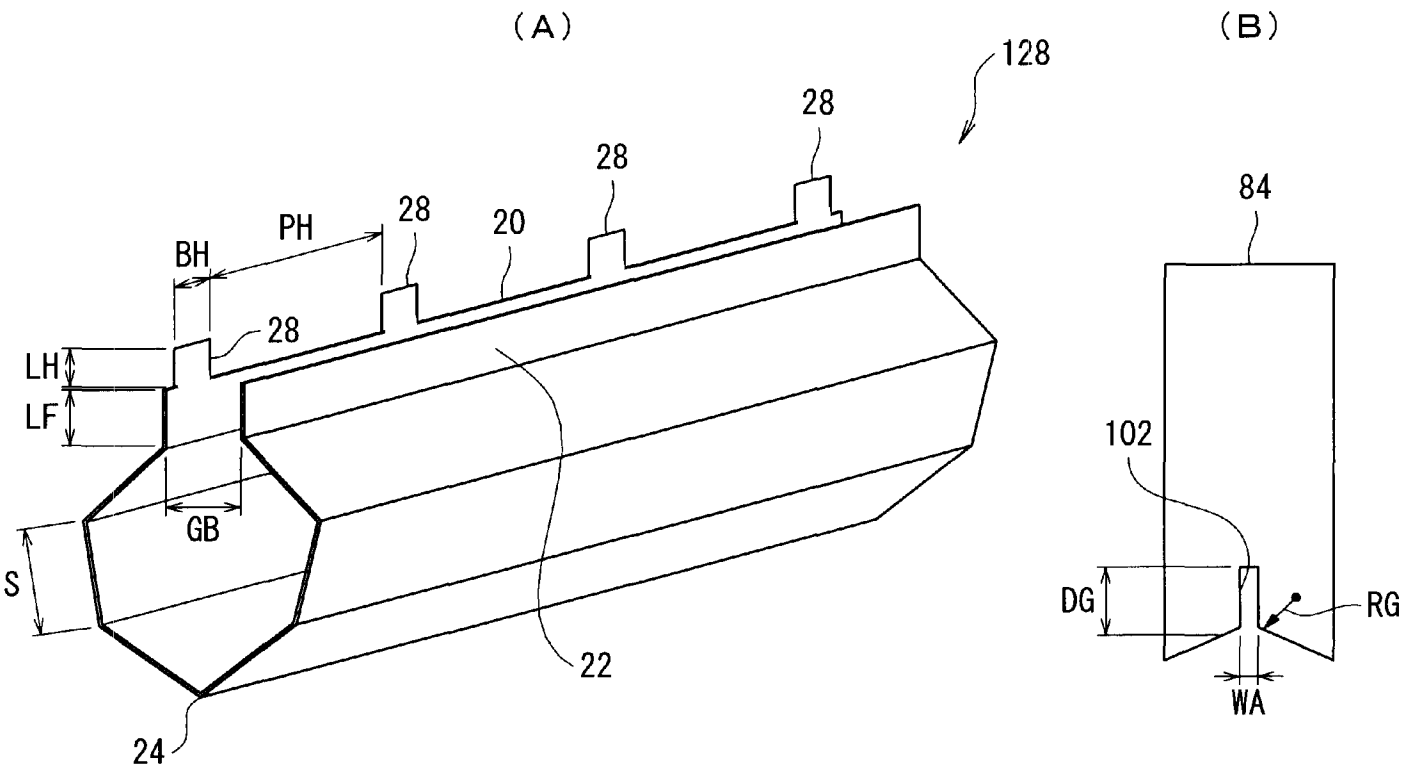
FIG. 14 is a perspective view and a front view illustrating an example of the structure of a closed structure part and a punch.

In addition, as shown in FIG. 14(B), the punch 84 including the slit clearance 102 having a depth DG of 30 mm and an opening width WA of 5 mm and the insert guide surfaces 104 having a radius of curvature RG of 1 mm is employed.

In contrast, in Example 1, a cold-rolled steel having a thickness of 1.2 mm and a tensile strength of 1180 MPa is employed as the blank 24. Such a blank 24 is subjected to the processes performed by the hemming press apparatus 80 in the closing step and the hemming press step. Thus, as shown in FIG. 8(A), a closed structure part 130 serving as an interim part is formed (press-formed).

The closed structure part 130 has a substantially rectangular cross section. A width B of the closed structure part 130 is 120 mm. A height H of the closed structure part 130 is 80 mm. The entire length of the closed structure part 130 is 800 mm. In addition, the protruding length LF of the flange portions 20 and 22 is set to 15 mm. The flange portion 20, which is one of the two flange portions, integrally includes a plurality of hemming prongs 28 protruding from the top portion of the flange portion 20. The hemming prongs 28 are processed in a preliminary hemming step before the blank 24 is mounted in the hemming press apparatus 80 and are preliminary bent.

Herein, the width BH of the hemming prong 28 is set to 10 mm. The protruding length LH of the hemming prongs 28 is also set to 10 mm. In addition, the separation distance PH of the hemming prongs 28 is set to 250 mm.

Figure 8:
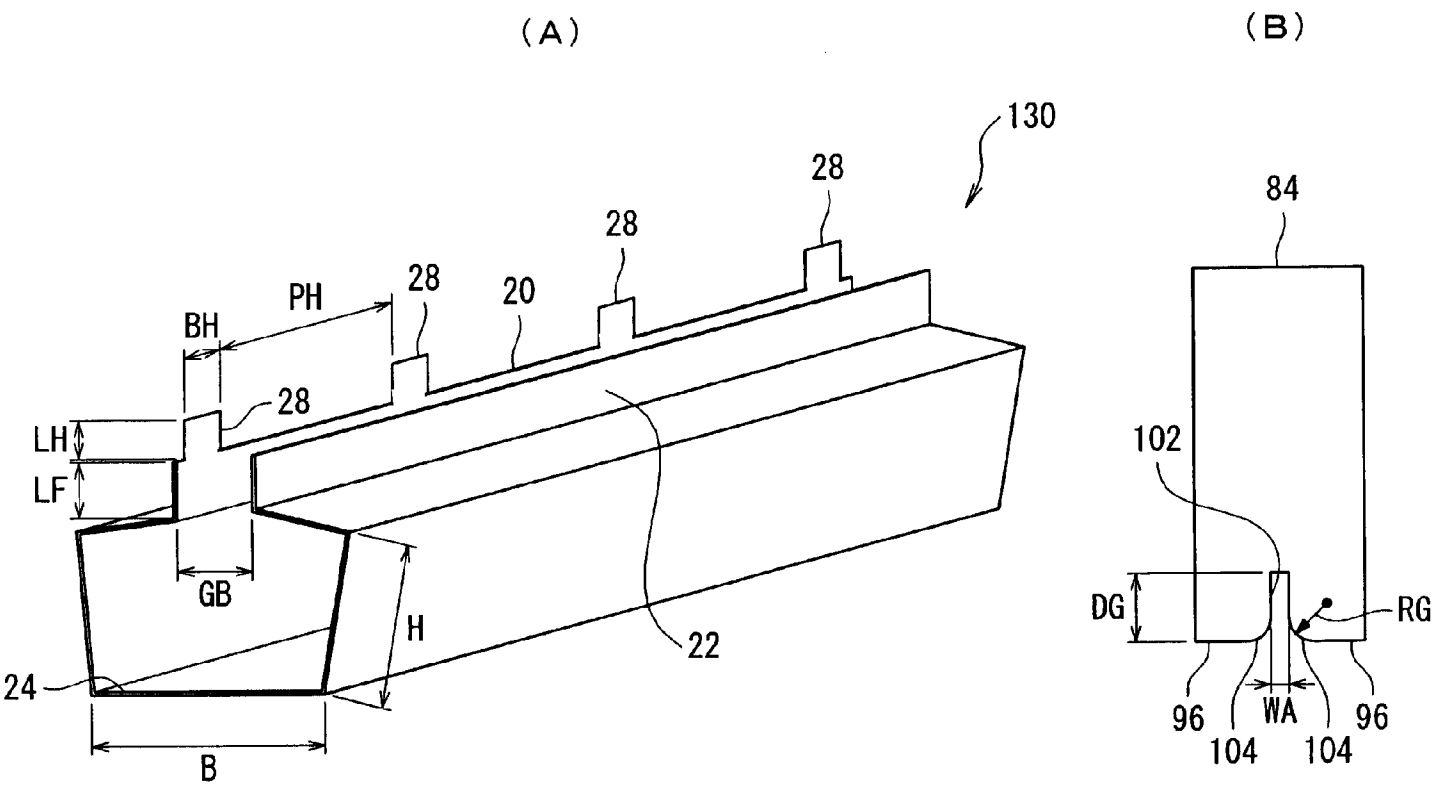
FIG. 8 is a perspective view and a front view illustrating an example of the structure of a closed structure part and a punch 1.

In addition, as shown in FIG. 8(B), the punch 84 including the slit clearance 102 having a depth DG of 30 mm and an opening width WA of 5 mm and the insert guide surfaces 104 having a radius of curvature RG of 30 mm is employed.

In contrast, in Example 2, a cold-rolled steel having a thickness of 1.2 mm and a tensile strength of 1180 MPa is employed as the blank 24. Such a blank 24 is subjected to the processes performed by the hemming press apparatus 80 in the closing step and the hemming press step. Thus, as shown in FIG. 9(A), a closed structure part 132 serving as an interim part is formed (press-formed).

The closed structure part 132 has a substantially regular hexagonal cross section. The length of a side S of the hexagonal cross section is 40 mm. The entire length of the closed structure part 132 is 800 mm. In addition, the protruding length LF of the flange portions 20 and 22 is set to 15 mm. The flange portion 20, which is one of the two flange portions, integrally includes a plurality of hemming prongs 28 protruding from the top portion of the flange portion 20. The hemming prongs 28 are processed in a preliminary hemming step before the blank 24 is mounted in the hemming press apparatus 80 and are preliminary bent.

Herein, the width BH of the hemming prong 28 is set to 10 mm. The protruding length LH of the hemming prongs 28 is also set to 10 mm. In addition, the separation distance PH of the hemming prongs 28 is set to 250 mm.

In addition, as shown in FIG. 9(B), the punch 84 including the slit clearance 102 having a depth DG of 30 mm and an opening width WA of 5 mm and the insert guide surfaces 104 having a radius of curvature RG of 30 mm is employed.

In contrast, in Example 3, a cold-rolled steel having a thickness of 1.2 mm and a tensile strength of 1180 MPa is employed as the blank 24. Such a blank 24 is subjected to the processes performed by the hemming press apparatus 80 in the closing step and the hemming press step. Thus, as shown in FIG. 15(A), a closed structure part 134 serving as an interim part is formed (press-formed).

The closed structure part 134 has an irregular hexagonal cross section. The width B of the bottom plate portion 54 of the closed structure part 134 is 120 mm. A width BS of a slope portion 58 that connects the side plate portion to the top plate portion is 30 mm, and a height H of the closed structure part 134 is 70 mm. The entire length of the closed structure part 134 is 800 mm. In addition, the protruding length LF of the flange portions 20 and 22 is set to 15 mm. The flange portion 20, which is one of the two flange portions, integrally includes a plurality of hemming prongs 28 protruding from the top portion of the flange portion 20. The hemming prongs 28 are processed in a preliminary hemming step before the blank 24 is mounted in the hemming press apparatus 80 and are preliminary bent.

Herein, the width BH of the hemming prong 28 is set to 10 mm. The protruding length LH of the hemming prongs 28 is also set to 10 mm. In addition, the separation distance PH of the hemming prongs 28 is set to 250 mm.

Figure 15:
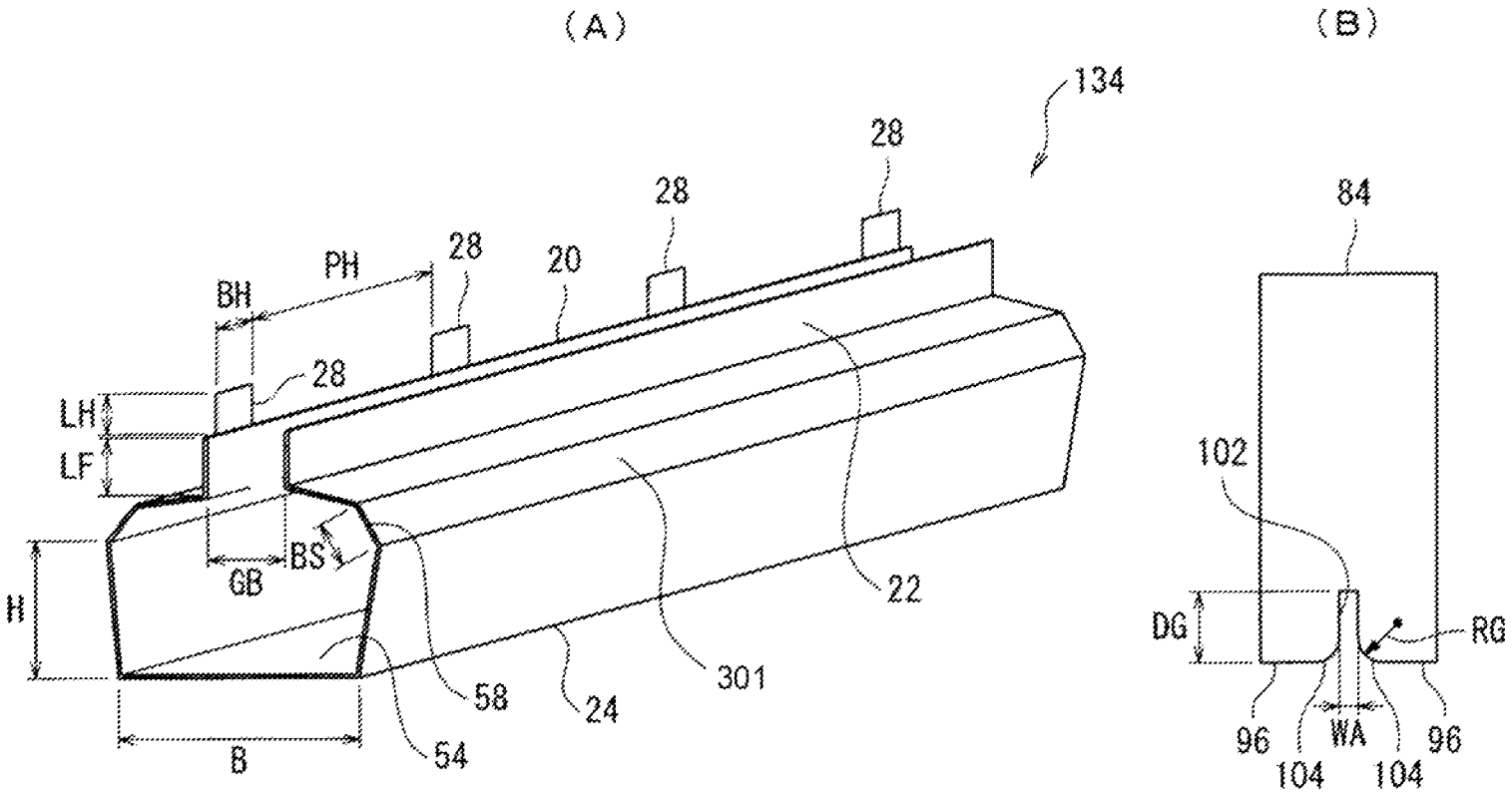
FIG. 15 is a perspective view and a front view illustrating another example of the structure of a closed structure part and a punch.

In addition, as shown in FIG. 15(B), the punch 84 including the slit clearance 102 having a depth DG of 30 mm and an opening width WA of 5 mm and the insert guide surfaces 104 having a radius of curvature RG of 30 mm is employed.

In contrast, in Example 4, a cold-rolled steel having a thickness of 1.2 mm and a tensile strength of 1180 MPa is employed as the blank 24. Such a blank 24 is subjected to the processes performed by the hemming press apparatus 80 in the closing step and the hemming press step. Thus, as shown in FIG. 16(A), a closed structure part 136 serving as an interim part is formed (press-formed).

The closed structure part 136 has an irregular octagonal cross section. Each of the widths B of the bottom plate portion 54 and the side plate portions 56 of the closed structure part 136 is 60 mm. Each of the width BS of a slope portion 301 and a width BN of two top plate portions 59 located outside the flange portions 20 and 22 is 30 mm. In addition, the protruding length LF of the flange portions 20 and 22 is set to 15 mm. The flange portion 20, which is one of the two flange portions, integrally includes a plurality of hemming prongs 28 protruding from the top portion of the flange portion 20. The hemming prongs 28 are processed in a preliminary hemming step before the blank 24 is mounted in the hemming press apparatus 80 and are preliminary bent.

Herein, the width BH of the hemming prong 28 is set to 10 mm. The protruding length LH of the hemming prongs 28 is also set to 10 mm. In addition, the separation distance PH of the hemming prongs 28 is set to 250 mm.

Figure 16:
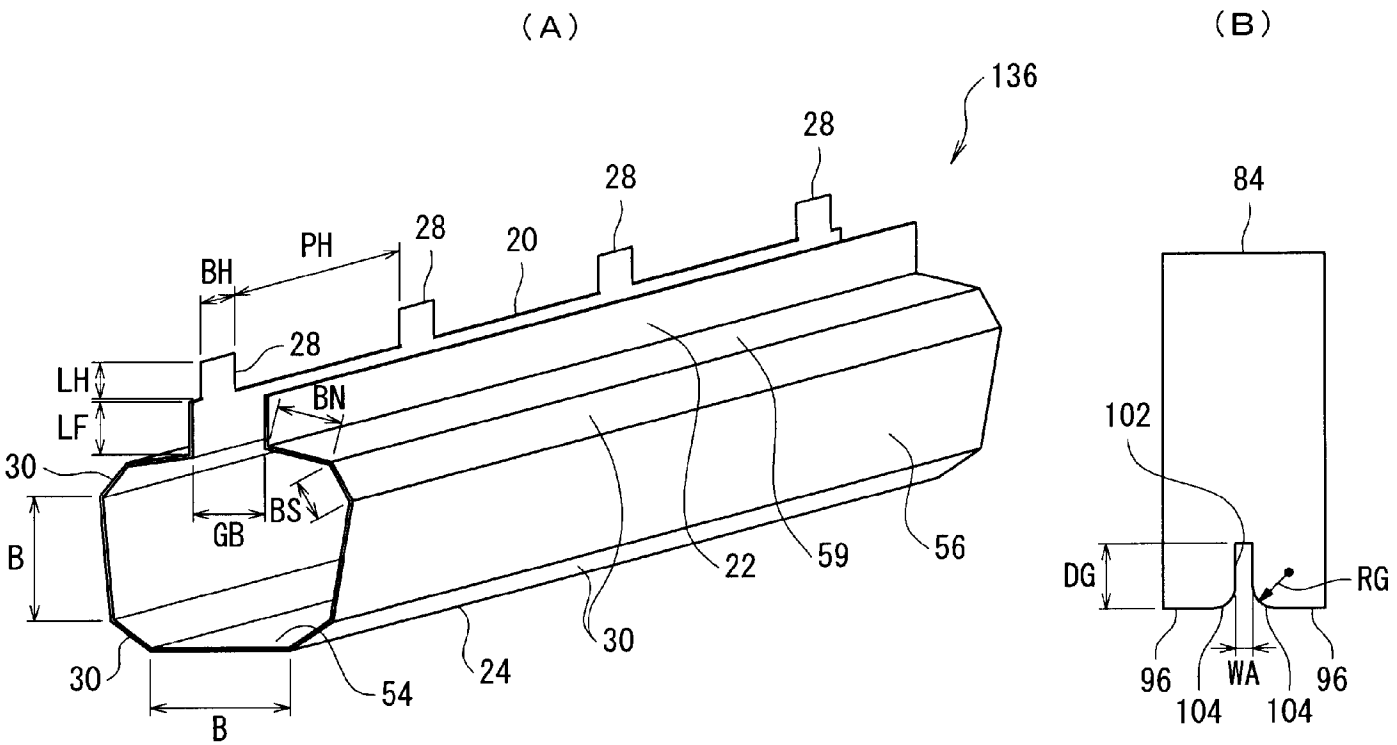
FIG. 16 is a perspective view and a front view illustrating yet another example of the structure of a closed structure part and a punch.

In addition, as shown in FIG. 16(B), the punch 84 including the slit clearance 102 having a depth DG of 30 mm and an opening width WA of 5 mm and the insert guide surfaces 104 having a radius of curvature RG of 30 mm is employed.

A method for evaluating the closed structure parts 120, 122, 124, and 126 according to the comparative examples and the closed structure parts 128, 130, 132, 134, and 136 according to the examples is described next. A gap distance GB (a maximum value) between the flange portions 20 and 22 (between two joint ends for the closed structure part 120) immediately before the blank 24 was subjected to a hemming press process using the hemming press apparatus 80 and a gap distance GA (a maximum value) between the flange portions 20 and 22 (between the two joint ends for the closed structure part 120) immediately after the blank 24 was subjected to the hemming press process were measured. In such a case, to increase the welding performance, it is desirable that the gap distance GA be minimized. If the gap distance GA is about 0.3 mm, the flange portions 20 and 22 can be reliably welded together without externally holding the flange portions 20 and 22.

Evaluation for the closed structure parts 120, 122, 124, and 126 and the closed structure parts 128, 130, 132, 134, and 136 is shown in the following TABLE 1.

TABLE 1

| Comparative Example Number and Example Number | Closed Structure Part Number | Gap Distance GB (mm) | Gap Distance GA (mm) |
|---|---|---|---|
| Comparative Example 1 | 120 | 4.0 | 3.0 |
| Comparative Example 2 | 122 | 4.0 | 2.0 |
| Comparative Example 3 | 124 | 4.0 | 3.0 |

TABLE 1-continued

| Comparative Example Number and Example Number | Closed Structure Part Number | Gap Distance GB (mm) | Gap Distance GA (mm) |
|---|---|---|---|
| Comparative Example 4 | 126 | 4.0 | 3.0 |
| Example 0 | 128 | 10.0 | 0.2 |
| Example 1 | 130 | 4.0 | 0.2 |
| Example 2 | 132 | 10.0 | 0.3 |
| Example 3 | 134 | 10.0 | 0.2 |
| Example 4 | 136 | 10.0 | 0.2 |

REFERENCE SIGNS LIST

10, 12, 14, 16 closed structure part
18 main body
20, 22 flange portion
24 blank
26 shoulder portion
27 protruding portion
28 hemming prong
30 first press forming apparatus
32 die
34 punch
36 hydraulic actuator
38 press forming surface
40 press concave portion
42 slope surface
44 press forming surface
46 press convex portion
48 slope surface
50 cylinder
52 plunger
54 bottom plate portion
56 side plate portion
58 slope portion
59 top plate portion
60 second press forming apparatus
62 die
64 punch
66 hydraulic actuator
67 blank insertion portion
68 press forming surface
70 blank supporting surface
74 press forming surface
76 cylinder
78 plunger
80 hemming press apparatus
82 insert core (press forming die)
83 side portion
84 punch (press forming die)
86 supporting pad
88 pressure cam
89 pressure surface
90 hydraulic actuator (driving means)
92 cam drive mechanism
94 blank supporting surface
96 press forming surface
98 press forming surface
100 blank supporting surface
102 slit clearance
104 insert guide surface
106 cylinder
108 plunger
120, 122, 124, 126, 128, 130, 132, 134, 136 closed structure part
301 slope portion

The invention claimed is:

1. A method for manufacturing a closed structure part having a closed section with a metal plate by pressing the metal plate using a press forming die and fixing a pair of flange portions made into a pair of joint ends of the metal plate to each other, the method comprising:

a pre-hemming step of bending a hemming prong protruding from a top end of one of the flange portions towards another flange portion;

a closing step of, after the pre-hemming step is completed, urging a pair of insert guide surfaces formed on the press forming die against a top portion of the one of the flange portions having the hemming prong therein, moving the press forming die in a predetermined pressing direction so that the two flange portions are brought closer to each other due to a force component perpendicular to the pressing direction generated by each of the insert guide surfaces, and guiding the pair of the flange portions into a slit clearance formed between the pair of insert guide surfaces of the press forming die;

and a hemming press step of, after the closing step is completed, further moving the press forming die in the pressing direction, inserting the pair of flange portions into the slit clearance, simultaneously bending the hemming prong with a pressing force transferred from an inner surface portion of the slit clearance to a top portion of the hemming prong so that an uppermost portion of the another flange portion is sandwiched between the hemming prong and the one of the flange portions, and the one of the flange portions is fixed to the another flange portion, and, simultaneously, pressing the metal plate using a press forming surface formed outside of each of the insert guide surfaces of the press forming die and press-forming outer portions of the pair of the flange portions of the metal plate into predetermined shapes.

2. The method according to claim 1, further comprising a welding step of, after the hemming press step is completed, fixing the one of the flange portions to the another flange portion by welding.

3. A press forming apparatus for use in the method according to claim 1, comprising:

the press forming die; and a driver that moves the press forming die in the pressing direction when the closing step and the hemming press step are performed;

wherein the press forming die has the pair of press forming surfaces having a shape corresponding to the outer portion of the pair of flange portions of the closed structure part, the pair of insert guide surfaces disposed on the outer sides of the press forming surfaces in a direction perpendicular to the pressing direction and oblique to the pressing direction and the direction perpendicular to the pressing direction, and the slit clearance formed between the pair of insert guide surfaces in the direction perpendicular to the pressing direction.

4. The press forming apparatus used for manufacturing a closed structure part according to claim 3, wherein depth of the slit clearance with respect to the insert guide surfaces is greater than or equal to 3 mm and less than or equal to 50 mm, and an opening width of the slit clearance in the direction perpendicular to the pressing direction is greater than or equal to 2 times a thickness of a metal plate serving as a material used for the closed structure part and less than or equal to 10 times the thickness of the metal plate.

5. A closed structure part manufactured using the method according to claim 1, comprising:

a main body having a closed section;

the flange portion formed in each of a pair of joint ends of the body; and the hemming prong protruding from the top end of one of the flange portions, the hemming prong being processed by hemming so that the one of the flange portions is fixed to the another flange portion.

6. The closed structure part according to claim 5, wherein a plurality of the hemming prongs are provided in the one of the flange portions in a width direction of the one of the flange portions with a predetermined separation distance (PH) therebetween, and wherein a width of each of the hemming prongs is set to a value greater than or equal to 2 times a thickness of the metal plate and less than or equal to a product length of the closed structure part, and wherein a protruding length of the hemming prong from the top end of the one of the flange portions is set to a value greater than or equal to 1 time the thickness of the metal plate serving as a material used for the closed structure part and less than or equal to 1.5 times a flange height, and wherein the separation distance (PH) is a value greater than or equal to 5 mm and less than or equal to a value obtained by subtracting widths of the hemming prongs from the product length.

7. A press forming apparatus for use in the method according to claim 2, comprising:

the press forming die; and a driver that moves the press forming die in the pressing direction when the closing step and the hemming press step are performed;

wherein the press forming die has the pair of press forming surfaces having a shape corresponding to the outer portion of the pair of flange portions of the closed structure part, the pair of insert guide surfaces disposed on the outer sides of the press forming surfaces in a direction perpendicular to the pressing direction and oblique to the pressing direction and the direction perpendicular to the pressing direction, and the slit clearance formed between the pair of insert guide surfaces in the direction perpendicular to the pressing direction.

8. A closed structure part manufactured using the method according to claim 2, comprising:

a main body having a closed section;

the flange portion formed in each of a pair of joint ends of the body; and the hemming prong protruding from the top end of one of the flange portions, the hemming prong being processed by hemming so that the one of the flange portions is fixed to the another flange portion.

9. The closed structure part according to claim 8, wherein a plurality of the hemming prongs are provided in the one of the flange portions in a width direction of the one of the flange portions with a predetermined separation distance (PH) therebetween, and wherein a width of each of the hemming prongs is set to a value greater than or equal to 2 times a thickness of the metal plate and less than or equal to a product length of the closed structure part, and wherein a protruding length of the hemming prong from the top end of the one of the flange portions is set to a value greater than or equal to 1 time the thickness of the metal plate serving as a material used for the closed structure part and less than or equal to 1.5 times a flange height, and wherein the separation distance (PH) is a value greater than or equal to 5 mm and less than or equal to a value obtained by subtracting widths of the hemming prongs from the product length.

10. The method according to claim 1, wherein the press forming die has the press forming surface and the insert guide surfaces.

* * * * *